US011276523B2

(12) United States Patent
Osawa et al.

(10) Patent No.: US 11,276,523 B2
(45) Date of Patent: Mar. 15, 2022

(54) IGNITION COIL FOR INTERNAL COMBUSTION ENGINE

(71) Applicant: DENSO CORPORATION, Kariya (JP)

(72) Inventors: Kengo Osawa, Kariya (JP); Masahiro Inagaki, Kariya (JP)

(73) Assignee: DENSO CORPORATION, Kariya (JP)

( * ) Notice: Subject to any disclaimer, the term of this patent is extended or adjusted under 35 U.S.C. 154(b) by 552 days.

(21) Appl. No.: 16/152,462

(22) Filed: Oct. 5, 2018

(65) Prior Publication Data

US 2019/0122815 A1 Apr. 25, 2019

(30) Foreign Application Priority Data

Oct. 6, 2017 (JP) ..... JP2017-196394
Sep. 6, 2018 (JP) ..... JP2018-166756

(51) Int. Cl.

| | |
|---|---|
| ***H01F 38/12*** | (2006.01) |
| ***H01F 27/32*** | (2006.01) |
| ***F02P 3/04*** | (2006.01) |
| ***H01F 27/02*** | (2006.01) |
| ***H01F 41/00*** | (2006.01) |
| ***H01F 27/24*** | (2006.01) |

(52) U.S. Cl.

CPC ..... *H01F 38/12* (2013.01); *F02P 3/04* (2013.01); *H01F 27/022* (2013.01); *H01F 27/24* (2013.01); *H01F 27/325* (2013.01); *H01F 41/005* (2013.01)

(58) Field of Classification Search

CPC .. H01F 38/12; H01F 2038/122; H01F 37/325; H01F 27/022; H01F 27/24; F02P 3/02; F02P 3/04

USPC ..... 336/90, 92, 96, 198; 123/634, 635

See application file for complete search history.

(56) References Cited

U.S. PATENT DOCUMENTS 5,349,320 A * 9/1994 Suzuki ..... H01F 27/02 336/107
5,767,758 A * 6/1998 Sakamaki ..... H01F 38/12 336/107
8,922,314 B2 * 12/2014 Kobayashi ..... H01F 38/12 336/90

(Continued)

FOREIGN PATENT DOCUMENTS

JP 2003-178925 6/2003
JP 2007194364 A * 8/2007
JP 2014022603 A * 2/2014

*Primary Examiner* — Tszfung J Chan
(74) *Attorney, Agent, or Firm* — Nixon & Vanderhye P.C.

(57) ABSTRACT

An ignition coil includes a primary coil, a secondary coil, a primary bobbin, a secondary bobbin, a center core, and a mold resin. The center core has a pair of collar portions protruding from a main body of the center core respectively to opposite sides in a protruding direction. The primary bobbin has a collar portion at least partially sandwiched between the collar portions of the center core and the secondary bobbin in a coil axial direction. The collar portion of the primary bobbin includes an overlapping portion that overlaps the collar portions of the center core in the coil axial direction and is bonded to the collar portions. The primary bobbin is formed of a thermoplastic resin and dispersed-phase particles dispersed in the thermoplastic resin. In the overlapping portion of the primary bobbin, there is formed a specific separating layer that separates adjacent layers in the coil axial direction.

7 Claims, 19 Drawing Sheets

(56) References Cited

U.S. PATENT DOCUMENTS

2017/0301461 A1 10/2017 Kato

* cited by examiner

IGNITION COIL FOR INTERNAL COMBUSTION ENGINE

CROSS-REFERENCE TO RELATED APPLICATIONS

This application is based on and claims priority from Japanese Patent Applications No. 2017-196394 filed on Oct. 6, 2017 and No. 2018-166756 filed on Sep. 6, 2018, the contents of which are hereby incorporated by reference in their entireties into this application.

BACKGROUND

1. Technical Field

The present invention relates to ignition coils for internal combustion engines.

2. Description of Related Art

Japanese Patent Application Publication No. JPH0677066A discloses an ignition coil for an internal combustion engine. The ignition coil includes a primary coil, a secondary coil, a primary bobbin, a secondary bobbin, a center core and a mold resin (or resin part). The primary coil and the secondary coil are magnetically coupled with each other. The primary bobbin has the primary coil wound thereon. The secondary bobbin has the secondary coil wound thereon. The center core is arranged inside the primary bobbin. The mold resin has components of the ignition coil embedded therein; these components include the primary coil, the secondary coil, the primary bobbin, the secondary bobbin, the center core and a permanent magnet.

Moreover, the primary bobbin is insert-molded with the center core as an insert. Consequently, it is possible to make at low cost the primary bobbin having the center core arranged thereinside; it is also possible to integrally form the primary bobbin and the center core into one piece, thereby reducing the parts count of the ignition coil. On the other hand, the secondary bobbin is assembled to the primary bobbin.

Furthermore, in the above ignition coil, part of the center core, part of the primary bobbin and part of the secondary bobbin are arranged to overlap each other in a coil axial direction. The center core is made of metal, whereas all of the primary bobbin, the secondary bobbin and the mold resin are made of resin.

However, with the above arrangement, at a location where the center core, the primary bobbin and the secondary bobbin overlap each other in the coil axial direction, stress may concentrate on the boundary between the primary bobbin and the secondary bobbin.

Specifically, the coefficient of linear expansion of the center core that is made of metal is smaller than the coefficient of linear expansion of each of the primary bobbin, the secondary bobbin and the mold resin that are made of resin. Therefore, when the temperature of the ignition coil is changed from high temperature to low, the amount of thermal shrinkage of the center core is less than the amount of thermal shrinkage of each of the primary bobbin, the secondary bobbin and the mold resin.

Moreover, the center core is insert-molded in and thus bonded to the primary bobbin. Therefore, when the temperature of the ignition coil is changed from high to low, the primary bobbin is restrained by the center core and thus the thermal shrinkage of the primary bobbin is limited. On the other hand, the secondary bobbin and the mold resin thermally shrink relatively greatly. Consequently, at the location where the center core, the primary bobbin and the secondary bobbin overlap each other in the coil axial direction, stress may concentrate on the boundary between the primary bobbin and the secondary bobbin, causing cracks to occur in the ignition coil and thereby lowering the electrical reliability of the ignition coil.

SUMMARY

According to one exemplary embodiment, there is provided a first ignition coil for an internal combustion engine. The first ignition coil includes: a primary coil and a secondary coil that are magnetically coupled with each other; a primary bobbin having the primary coil wound thereon; a secondary bobbin having the secondary coil wound thereon; a center core; and a mold resin having the primary coil, the secondary coil, the primary bobbin, the secondary bobbin and the center core embedded therein. The center core has a main body arranged inside the primary bobbin and a pair of collar portions protruding from the main body respectively to opposite sides in a protruding direction crossing a coil axial direction. The primary bobbin has, in one part thereof in the coil axial direction, a main body on which the primary coil is wound. The primary bobbin also has, in another part thereof in the coil axial direction, a collar portion that is at least partially sandwiched between the collar portions of the center core and the secondary bobbin in the coil axial direction. The collar portion of the primary bobbin includes an overlapping portion of the primary bobbin which overlaps the collar portions of the center core in the coil axial direction. The overlapping portion of the primary bobbin is bonded to the collar portions of the center core. The primary bobbin is formed of a thermoplastic resin and dispersed-phase particles that are dispersed in the thermoplastic resin and have a lower elasticity than the thermoplastic resin. In the overlapping portion of the primary bobbin, there is formed a specific separating layer that separates adjacent layers in the coil axial direction.

With the above configuration, that part of the overlapping portion of the primary bobbin which is on the secondary bobbin side of the specific separating layer is separated from the specific separating layer; thus it is difficult for that part of the overlapping portion to be restrained by the collar portions of the center core when the temperature of the first ignition coil is changed from high to low. Consequently, when the temperature of the first ignition coil is changed from high to low, it is possible to prevent stress concentration from occurring at the boundary between the collar portion of the primary bobbin and the secondary bobbin in the coil axial direction. As a result, it is possible to suppress cracks from occurring in the first ignition coil, thereby ensuring high electrical reliability of the first ignition coil.

According to another exemplary embodiment, there is provided a second ignition coil for an internal combustion engine. The second ignition coil includes: a primary coil and a secondary coil that are magnetically coupled with each other; a primary bobbin having the primary coil wound thereon; a secondary bobbin having the secondary coil wound thereon; a center core; and a mold resin having the primary coil, the secondary coil, the primary bobbin, the secondary bobbin and the center core embedded therein. The center core has a main body arranged inside the primary bobbin and a pair of collar portions protruding from the main body respectively to opposite sides in a protruding direction crossing a coil axial direction. The primary bobbin has, in one part thereof in the coil axial direction, a main body on which the primary coil is wound. The primary bobbin also has, in another part thereof in the coil axial direction, a collar portion that is at least partially sandwiched between the collar portions of the center core and the secondary bobbin in the coil axial direction. The collar portion of the primary bobbin includes an overlapping portion of the primary bobbin which overlaps the collar portions of the center core in the coil axial direction. A separating member is provided, at least between the overlapping portion of the primary bobbin and the collar portions of the center core, to cause separation between the primary bobbin and the center core.

With the above configuration, when the temperature of the second ignition coil is changed from high to low, the overlapping portion of the primary bobbin is separated from the collar portions of the center core; thus the overlapping portion of the primary bobbin is not restrained by the collar portions of the center core. Consequently, when the temperature of the second ignition coil is changed from high to low, it is possible to prevent stress concentration from occurring at the boundary between the collar portion of the primary bobbin and the secondary bobbin in the coil axial direction. As a result, it is possible to suppress cracks from occurring in the second ignition coil, thereby ensuring high electrical reliability of the second ignition coil.

BRIEF DESCRIPTION OF THE DRAWINGS

The present invention will be understood more fully from the detailed description given hereinafter and from the accompanying drawings of exemplary embodiments, which, however, should not be taken to limit the present invention to the specific embodiments but are for the purpose of explanation and understanding only.

In the accompanying drawings.

DESCRIPTION OF EMBODIMENTS

Figure 1:
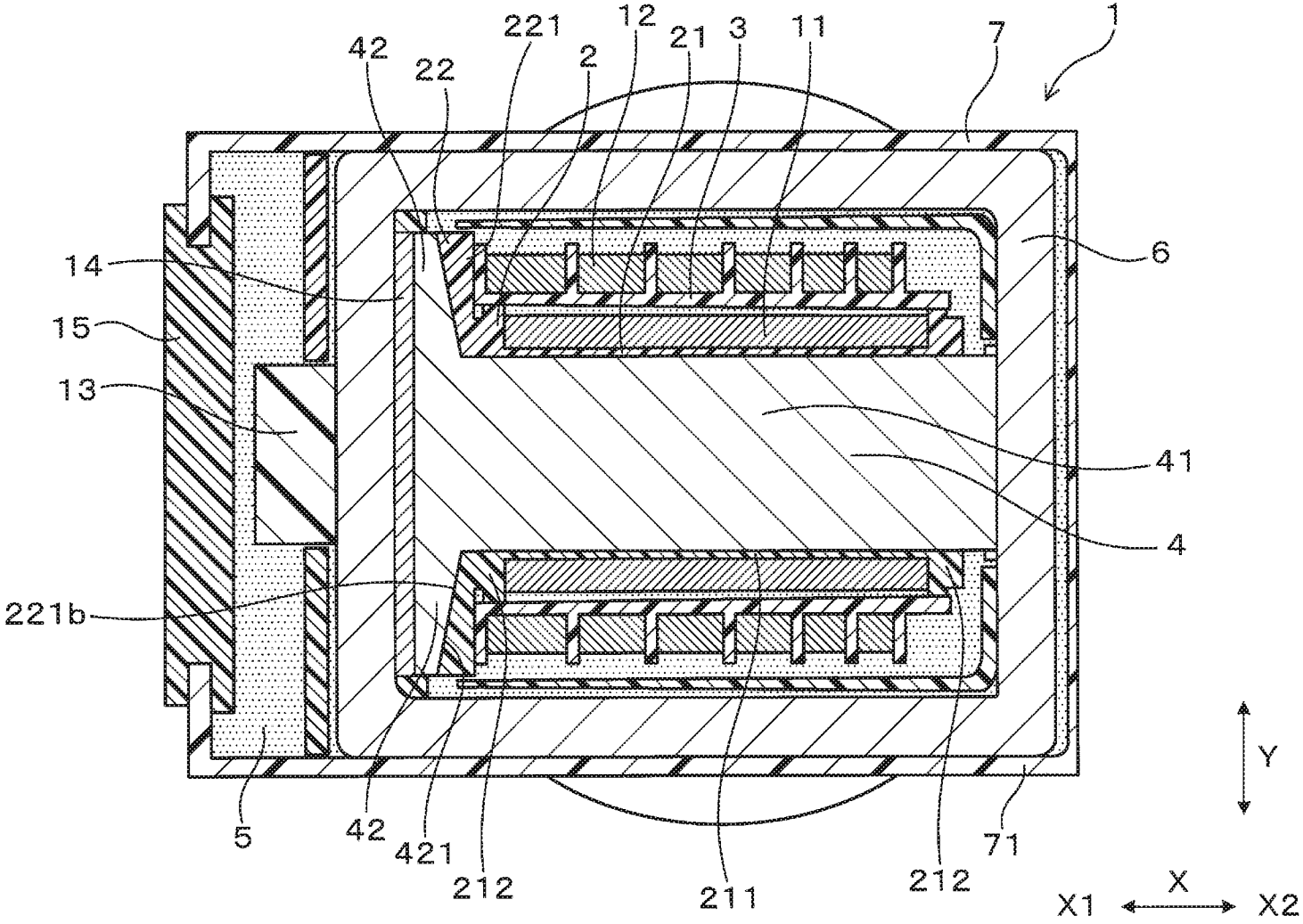
FIG. 1 is a lateral cross-sectional view of an ignition coil according to a first embodiment.

Exemplary embodiments will be described hereinafter with reference to FIGS. 1-27. It should be noted that for the sake of clarity and understanding, identical components having identical functions throughout the whole description have been marked, where possible, with the same reference numerals in each of the figures and that for the sake of avoiding redundancy, descriptions of identical components will not be repeated.

First Embodiment

An ignition coil 1 according to the first embodiment will be described with reference to FIGS. 1-9.

As shown in FIG. 1, in the present embodiment, the ignition coil 1 includes a primary coil 11, a secondary coil 12, a primary bobbin 2, a secondary bobbin 3, a center core 4 and a mold resin (or resin part) 5. The primary coil 11 and the secondary coil 12 are magnetically coupled with each other. The primary bobbin 2 has the primary coil 11 wound thereon. The secondary bobbin 3 has the secondary coil 12 wound thereon. The center core 4 is arranged inside the primary bobbin 2. The mold resin 5 has the primary coil 11, the secondary coil 12, the primary bobbin 2, the secondary bobbin 3 and the center core 4 embedded therein.

The center core 4 has a main body 41 arranged inside the primary coil 11 and a pair of collar portions 42 protruding from the main body 41 respectively to opposite sides in a direction Y crossing a coil axial direction X. Hereinafter, the direction Y crossing the coil axial direction X will be simply referred to as the protruding direction Y.

The collar portions 42 are formed to increase the cross-sectional area of the center core 4 perpendicular to the coil axial direction X. Consequently, it becomes possible to arrange a magnet 14, which has a larger cross-sectional area perpendicular to the coil axial direction X than the main body 41 of the center core 4, between an outer core 6 and that end of the center core 4 where the collar portions 42 are formed.

The primary bobbin 2 has, in one part thereof in the coil axial direction X, a main body 21 on which the primary coil 11 is wound. The primary bobbin 2 also has, in another part thereof in the coil axial direction X, a collar portion 22 that is at least partially sandwiched (or fixedly held) between the collar portions 42 of the center core 4 and the secondary bobbin 3 in the coil axial direction X.

The collar portion 22 includes an overlapping portion 221 of the primary bobbin 2 which overlaps the collar portions 42 of the center core 4 in the coil axial direction X. The overlapping portion 221 of the primary bobbin 2 is bonded to the collar portions 42 of the center core 4.

Figure 2:
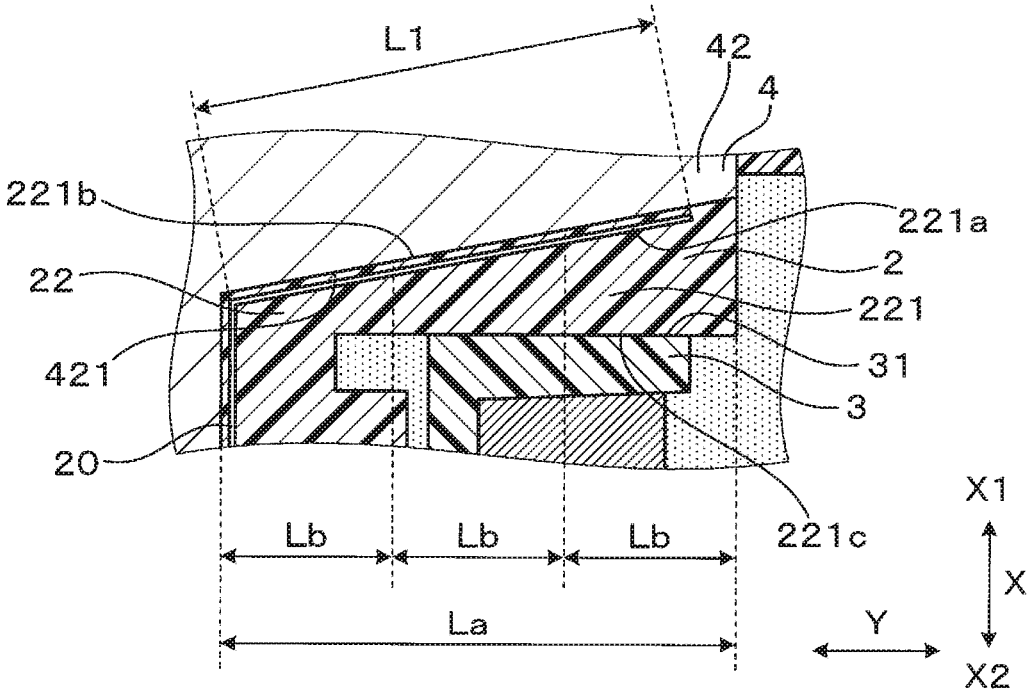
FIG. 2 is an enlarged view of part of FIG. 1 around an overlapping portion of a primary bobbin of the ignition coil according to the first embodiment.

In the present embodiment, the primary bobbin 2 is formed of a thermoplastic resin and dispersed-phase particles that are dispersed in the thermoplastic resin and have a lower elasticity than the thermoplastic resin. Moreover, as shown in FIGS. 2 and 4, in the overlapping portion 221 of the primary bobbin 2, there is formed a specific separating layer 221*a* that separates adjacent layers in the coil axial direction X. In addition, it should be noted that the specific separating layer 221*a* is not shown in FIGS. 1 and 3 for the sake of simplicity.

Next, the configuration of the ignition coil 1 according to the present embodiment will be described in detail.

First, it should be noted that the coil axial direction X denotes the winding axis direction (i.e., the direction of the winding axis) of both the primary coil 11 and the secondary coil 12. In addition, the direction which is perpendicular to both the coil axial direction X and the protruding direction Y will be referred to as the height direction Z hereinafter.

In the present embodiment, the ignition coil 1 is designed to be used in an internal combustion engine of, for example, a motor vehicle or a cogeneration system.

As shown in FIG. 1, the center core 4 is substantially T-shaped in cross section. The center core 4 is formed by laminating a plurality of flat steel sheets, which are made of a soft-magnetic material, in a thickness direction thereof. The lamination direction of the center core 4 (i.e., the thickness direction of the steel sheets forming the center core 4) coincides with the height direction Z.

The main body 41 of the center core 4 is shaped in a rectangular cuboid whose length direction coincides with the coil axial direction X. The collar portions 42 of the center core 4 are formed to protrude, from one end portion of the main body 41 in the coil axial direction X, respectively to opposite sides in the protruding direction Y.

Hereinafter, that side in the coil axial direction X where the collar portions 42 of the center core 4 are formed will be referred to as X1 side and the opposite side to the X1 side will be referred to as X2 side.

As shown in FIG. 1, back surfaces 421 of the collar portions 42 of the center core 4, which face the X2 side in the coil axial direction X, are formed obliquely with respect to the coil axial direction X so that the protruding amount of the collar portions 42 from the main body 41 in the protruding direction Y increases as the back surfaces 421 extend from the main body 41 to the X1 side in the coil axial direction X.

As described previously, the primary bobbin 2 is insert-molded with the center core 4 arranged thereinside. Consequently, as shown in FIG. 1, the center core 4 is embedded inside the primary bobbin 2 with both end surfaces of the center core 4 in the coil axial direction X exposed from the primary bobbin 2.

The main body 21 of the primary bobbin 2 has a tubular portion 211 and a pair of protruding portions 212. The protruding portions 212 are formed, respectively at opposite ends of the tubular portion 211 in the coil axial direction X, to protrude radially outward (i.e., in the protruding direction Y) from the tubular portion 211. That is, the protruding portions 212 are spaced from each other in the coil axial direction X. On the outer peripheral surface of the tubular portion 211, there is wound the primary coil 11 between the protruding portions 212.

As shown in FIG. 1, the collar portion 22 of the primary bobbin 2 is formed on the X1 side of the main body 21 of the primary bobbin 2 in the coil axial direction X. Moreover, the collar portion 22 of the primary bobbin 2 is located radially outside the surface of the main body 41 of the center core 4. In addition, the collar portion 22 of the primary bobbin 2 adjoins the collar portions 42 of the center core 4.

As shown in FIGS. 1 and 2, in the present embodiment, the overlapping portion 221 of the primary bobbin 2 constitutes at least part of the collar portion 22 of the primary bobbin 2. A front surface 221*b* of the overlapping portion 221 of the primary bobbin 2, which faces the X1 side in the coil axial direction X, is formed parallel to the back surfaces 421 of the collar portions 42 of the center core 4. Moreover, the front surface 221*b* of the overlapping portion 221 of the primary bobbin 2 is bonded to the back surfaces 421 of the collar portions 42 of the center core 4. On the other hand, a back surface 221*c* of the overlapping portion 221 of the primary bobbin 2, which faces the X2 side in the coil axial direction X, is formed perpendicular to the coil axial direction X.

As shown in FIG. 2, in the overlapping portion 221 of the primary bobbin 2, the specific separating layer 221*a* is formed in the vicinity of the front surface 221*b* of the overlapping portion 221. In the present embodiment, the specific separating layer 221*a* is formed along a plane parallel to the front surface 221*b* of the overlapping portion 221. In other words, the specific separating layer 221*a* is formed along a plane oblique (or nonparallel) to the coil axial direction X. Moreover, at least part of the specific separating layer 221*a* is formed to overlap both a front surface 31 of the secondary bobbin 3 and the collar portions 42 of the center core 4 in the coil axial direction X; the front surface 31 of the secondary bobbin 3 faces the primary bobbin 2 in the coil axial direction X.

As shown in FIG. 2, when viewed along the height direction Z, the specific separating layer 221*a* has a length L1 that is greater than or equal to a first predetermined length Lb; the first predetermined length Lb is ⅓ of the length La of each of the collar portions 42 of the center core 4 in the protruding direction Y. In other words, when viewed along the height direction Z, the length L1 of the specific separating layer 221*a* in the longitudinal direction of the specific separating layer 221*a* is greater than or equal to ⅓ of the length La of each of the collar portions 42 of the center core 4 in the protruding direction Y.

In the present embodiment, the specific separating layer 221*a* is formed continuously from a position close to the inner end of the overlapping portion 221 of the primary bobbin 2 in the protruding direction Y to a position close to the outer end of the overlapping portion 221 in the protruding portion Y.

Figure 10:
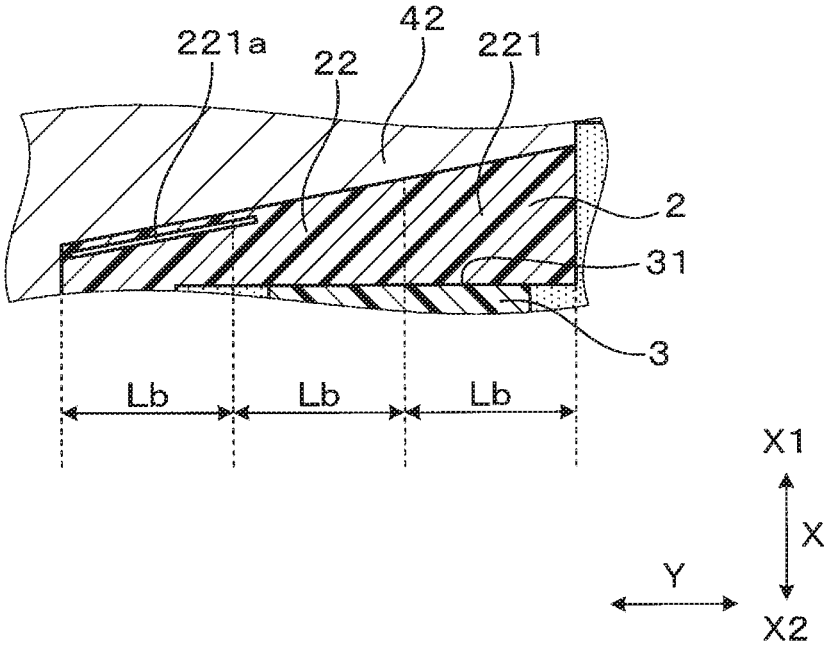
FIG. 10 is an enlarged cross-sectional view, corresponding to FIG. 2, illustrating a first modification of the first embodiment.
Figure 11:
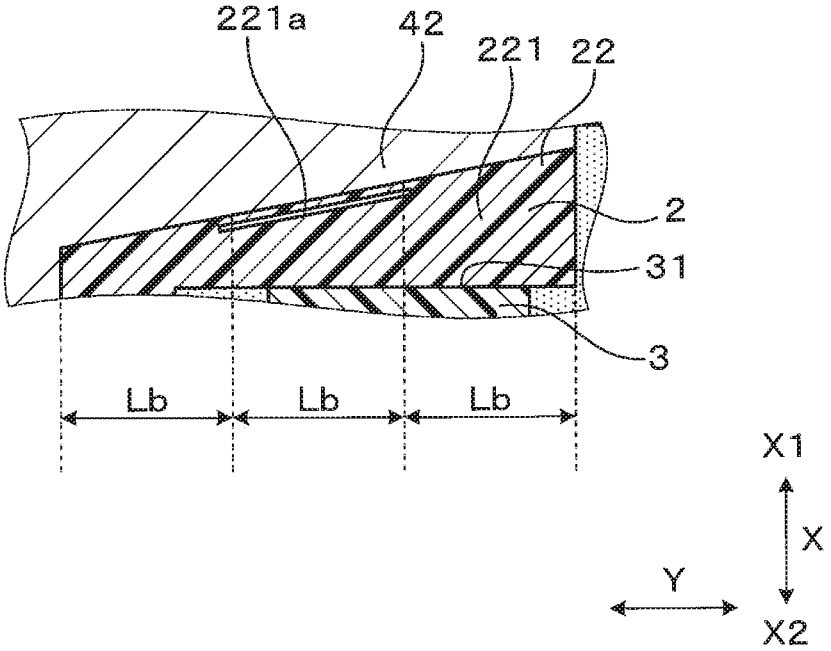
FIG. 11 is an enlarged cross-sectional view, corresponding to FIG. 2, illustrating a second modification of the first embodiment.
Figure 12:
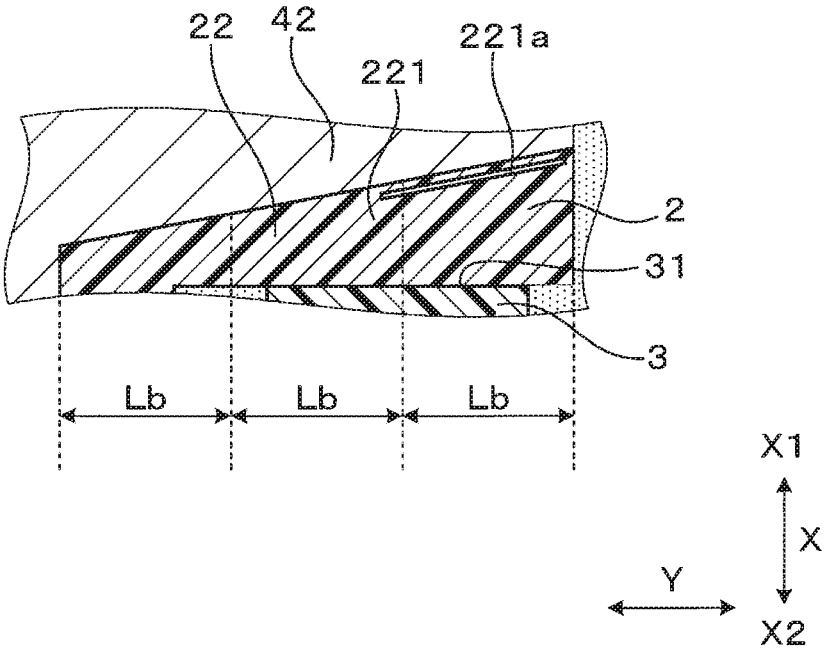
FIG. 12 is an enlarged cross-sectional view, corresponding to FIG. 2, illustrating a third modification of the first embodiment.

The formation range and formation location of the specific separating layer 221*a* as viewed along the height direction Z are not particularly limited provided that the length L1 of the specific separating layer 221*a* is greater than or equal to the first predetermined length Lb. For example, the specific separating layer 221*a* may alternatively be formed as shown in FIGS. 10-12. In addition, the formation range and formation location of the specific separating layer 221*a* may be adjusted by, for example, devising (or changing) the molding condition of the primary bobbin 2.

Figure 13:
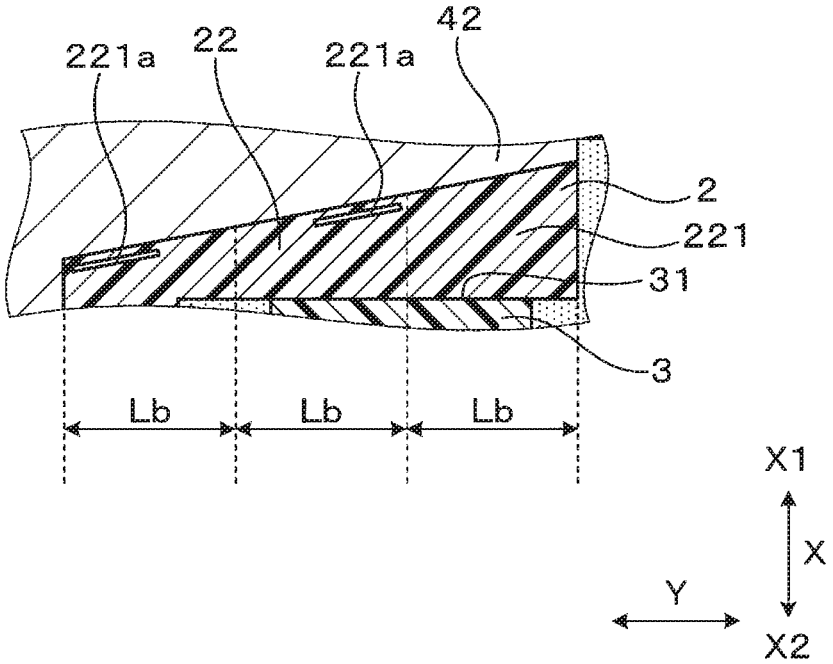
FIG. 13 is an enlarged cross-sectional view, corresponding to FIG. 2, illustrating a fourth modification of the first embodiment.
Figure 14:
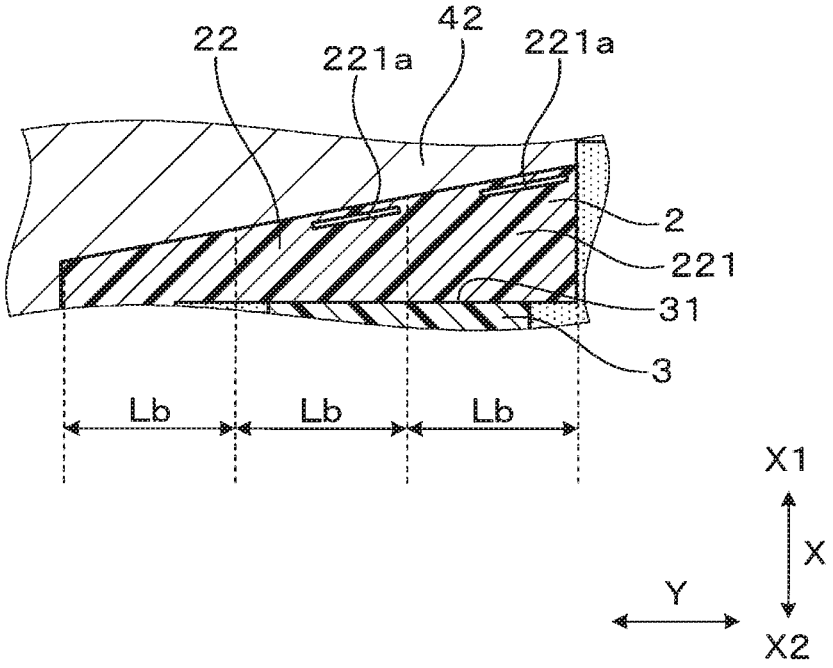
FIG. 14 is an enlarged cross-sectional view, corresponding to FIG. 2, illustrating a fifth modification of the first embodiment.

Moreover, the specific separating layer 221*a* may alternatively be formed discontinuously to include a plurality of segments as shown in FIGS. 13 and 14. In this case, it is preferable that when viewed along the height direction Z, the sum of lengths of the segments of the specific separating layer 221*a* be greater than or equal to the first predetermined length Lb.

As shown in FIG. 4, the specific separating layer 221*a* has a length L2 in the height direction Z; the length L2 is greater than or equal to a second predetermined length Ld that is ½ of the length Lc of each of the collar portions 42 of the center core 4 in the height direction Z.

More particularly, in the present embodiment, the specific separating layer 221*a* is formed continuously in the height direction Z to have its length L2 greater than the second predetermined length Ld and less than the length Lc of each of the collar portions 42 of the center core 4 in the height direction Z.

The formation range and formation location of the specific separating layer 221*a* in the height direction Z are not particularly limited provided that the length L2 of the specific separating layer 221*a* is greater than or equal to the second predetermined length Ld. Moreover, the specific separating layer 221*a* may alternatively be formed discontinuously in the height direction Z to include a plurality of segments. In this case, it is preferable that the sum of lengths of the segments of the specific separating layer 221*a* in the height direction Z be greater than or equal to the second predetermined length Ld.

Furthermore, in the primary bobbin 2, there may be further formed one or more other separating layers 20 in addition to the specific separating layer 221*a*. For example, as shown in FIG. 2, in the present embodiment, there is further formed, in addition to the specific separating layer 221*a*, another separating layer 20 that extends to the X2 side in the coil axial direction X from the inner end of the specific separating layer 221*a* in the protruding direction Y. In addition, the separating layers 20 including the specific separating layer 221*a* will be described in detail later.

As described previously, in the present embodiment, the primary bobbin 2 is formed of a thermoplastic resin and dispersed-phase particles that are dispersed in the thermoplastic resin and have a lower elasticity than the thermoplastic resin. More particularly, in the present embodiment, the thermoplastic resin is a PBT (polybutylene terephthalate) resin; the dispersed-phase particles are elastomer particles that have a lower elasticity than the PBT resin. Moreover, the elastomer content of the primary bobbin 2 is 3-10 mass %.

As shown in FIG. 1, the secondary bobbin 3 is arranged to have both the main body 21 of the primary bobbin 2 and the primary coil 11 inserted therein. As shown in FIGS. 2 and 4, the front surface 31 of the secondary bobbin 3 is formed parallel to the back surface 221*c* of the overlapping portion 221 of the primary bobbin 2. Moreover, the front surface 31 of the secondary bobbin 3 is arranged adjacent to and facing the back surface 221*c* of the overlapping portion 221 of the primary bobbin 2. In addition, it should be noted that the front surface 31 of the secondary bobbin 3 may be either in contact or out of contact with the back surface 221*c* of the overlapping portion 221 of the primary bobbin 2.

Figure 3:
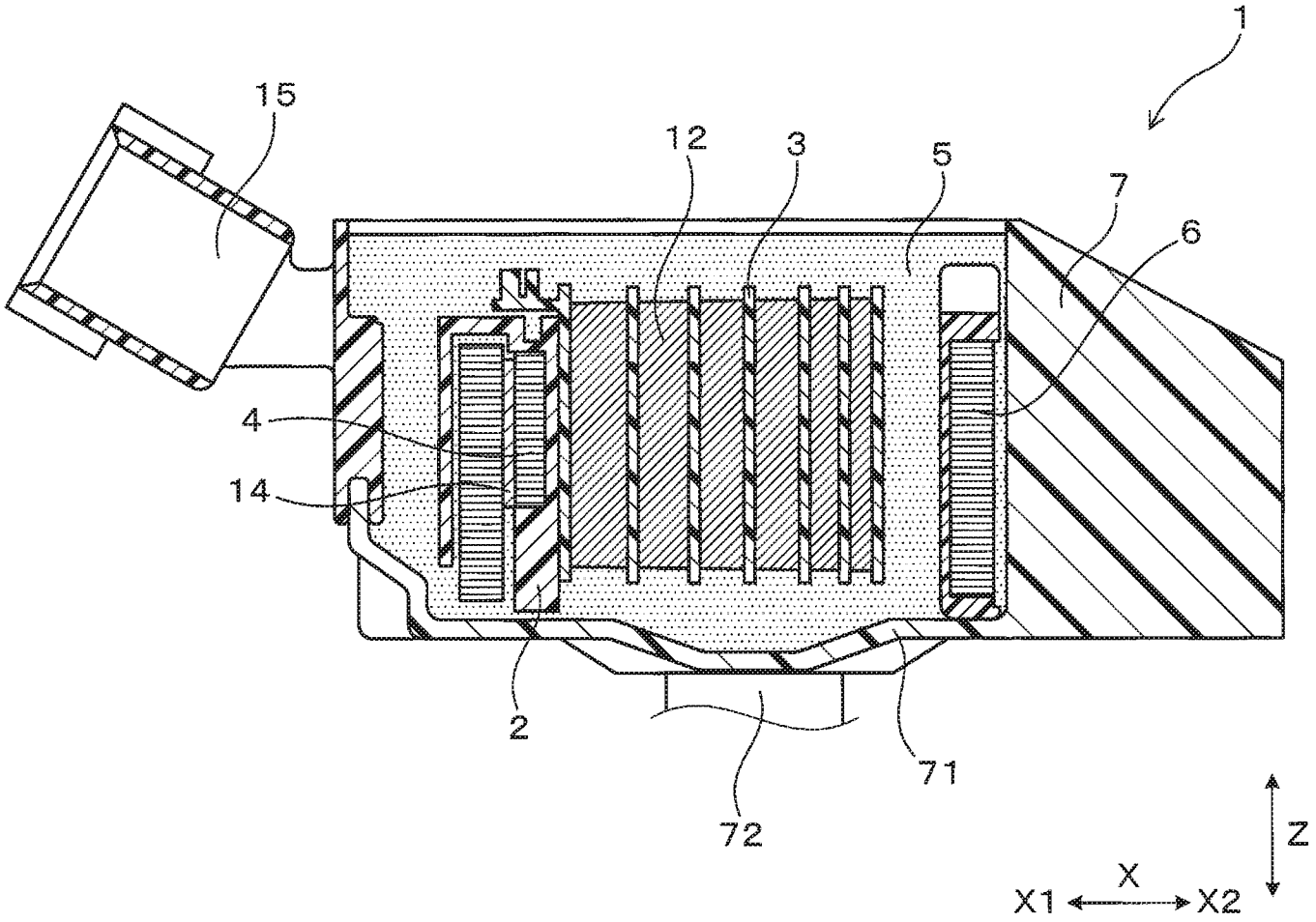
FIG. 3 is a longitudinal cross-sectional view, taken along a plane through the overlapping portion of the primary bobbin, of the ignition coil according to the first embodiment.
Figure 4:
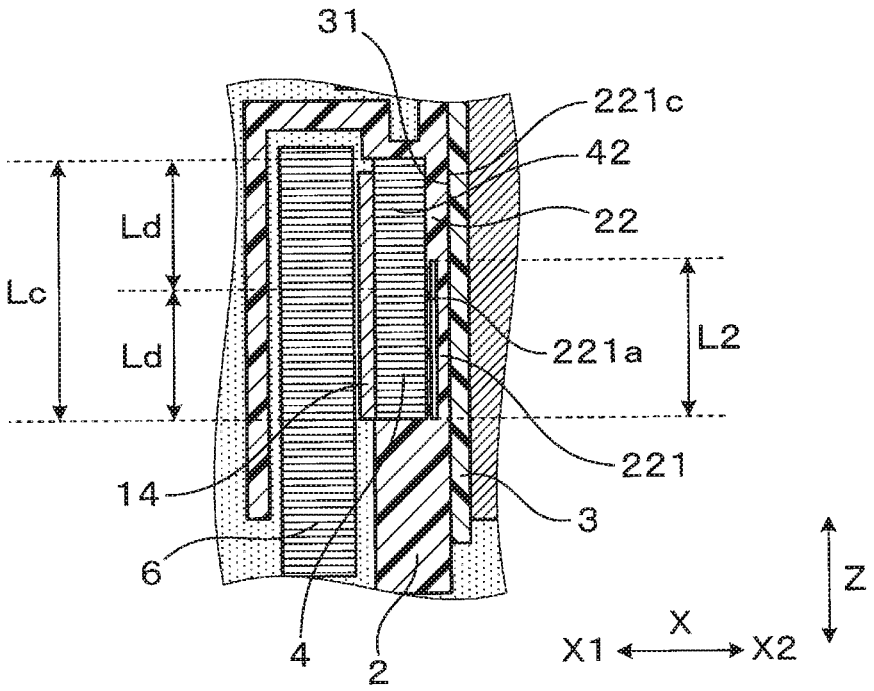
FIG. 4 is an enlarged view of part of FIG. 3 around the overlapping portion of the primary bobbin of the ignition coil according to the first embodiment.

As shown in FIGS. 1 and 3, the ignition coil 1 includes the outer core 6 that forms, together with the center core 4, a closed magnetic circuit in the ignition coil 1. The outer core 6 is arranged on the outer peripheral side of the primary coil 11, the secondary coil 12 and the center core 4. More particularly, in the present embodiment, the outer core 6 is ring-shaped so that when viewed along the height direction Z, the outer core 6 surrounds the primary coil 11, the secondary coil 12 and the center core 4. Similar to the center core 4, the outer core 6 is also formed by laminating a plurality of flat steel sheets, which are made of a soft-magnetic material, in a thickness direction thereof. The lamination direction of the outer core 6 (i.e., the thickness direction of the steel sheets forming the outer core 6) coincides with the height direction Z.

As shown in FIGS. 1 and 3, the ignition coil 1 also includes a case 7. The case 7 has a main body 71 that receives therein the primary and secondary coils 11 and 12, the primary and secondary bobbins 2 and 3, the center core 4, the outer core 6 and other components of the ignition coil 1. Here, the other components of the ignition coil 1 include an igniter 13 and the magnet 14. The main body 71 of the case 7 opens on one side in the height direction Z.

The igniter 13 performs energization and deenergization of the primary coil 11 (i.e., supplies electric current to the primary coil 11 and interrupts the supply of electric current to the primary coil 11).

The magnet 14 is provided to improve the output voltage of the ignition coil 1. More specifically, the magnet 14 is provided to apply a magnetic bias to the center core 4, thereby increasing the amount of change in magnetic flux during the deenergization of the primary coil 11 (i.e., during the interruption of supply of electric current to the primary coil 11) and thus the voltage induced in the secondary coil 12.

As shown in FIG. 3, the case 7 has, on the side opposite to the side where the main body 71 of the case 7 opens, a tubular high-voltage tower portion 72 that is formed to protrude from the main body 71 in the height direction Z. Moreover, though not shown in the figures, in a main body 71-side end portion of the high-voltage tower portion 72, there is fitted a high-voltage output terminal that is made of metal. Consequently, the main body 71-side end portion of the high-voltage tower portion 72 is closed.

As shown in FIGS. 1 and 3, in the main body 71 of the case 7, there is filled the mold resin 5. In the present embodiment, the mold resin 5 is implemented by, for example, an epoxy resin. Moreover, in the mold resin 5, there are embedded the primary and secondary coils 11 and 12, the primary and secondary bobbins 2 and 3, the center core 4, the outer core 6 and the other components of the ignition coil 1. In addition, the mold resin 5 is also impregnated into the minute gap between the primary coil 11 and the outer peripheral surface of the primary bobbin 2, thereby bonding the primary coil 11 to the primary bobbin 2.

As shown in FIG. 3, in the main body 71 of the case 7, there is fitted a connector 15 for externally connecting the ignition coil 1. Moreover, as shown in FIG. 5, in the present embodiment, the connector 15 is formed integrally with the primary bobbin 2.

Figure 5:
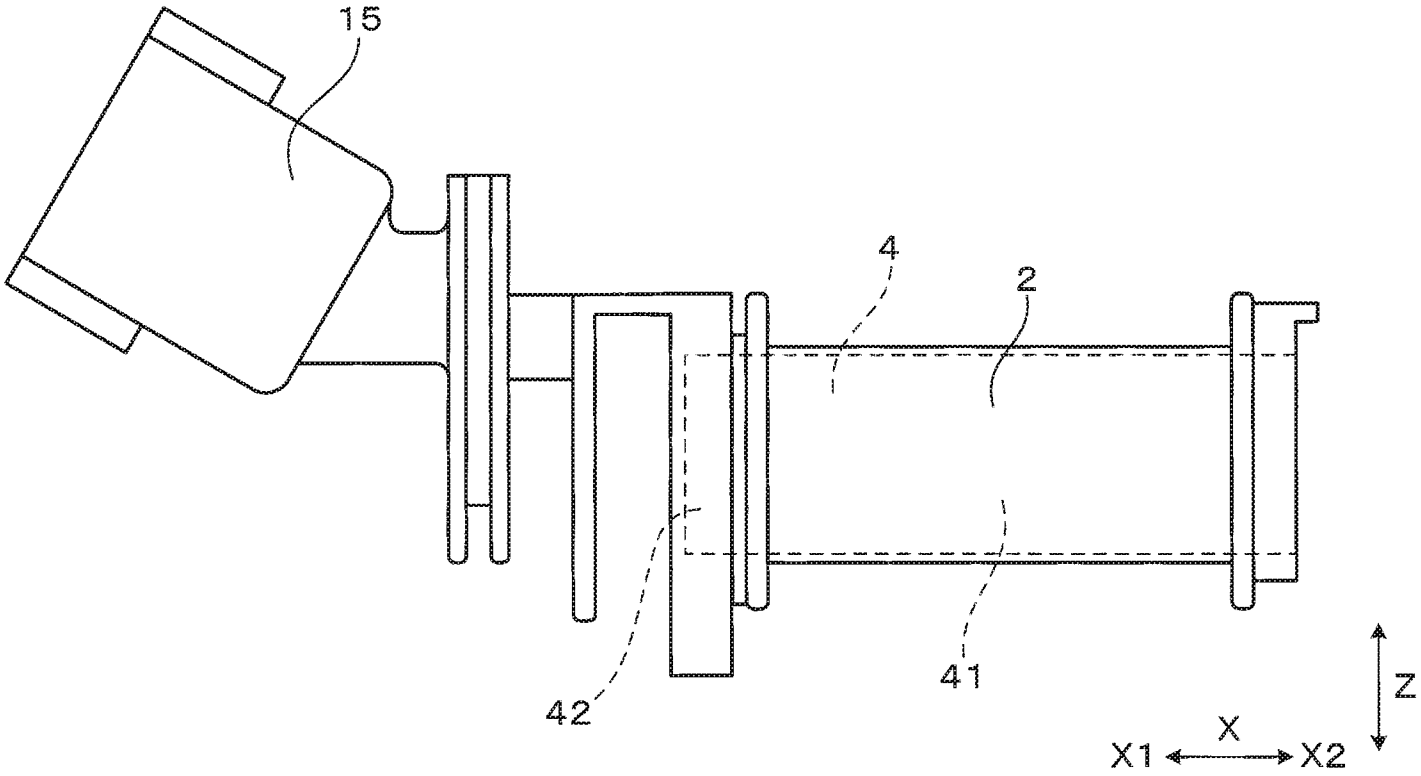
FIG. 5 is a side view of an assembly which includes the primary bobbin and a connector of the ignition coil according to the first embodiment.

In addition, it should be noted that: the contour of the center core 4 is shown with dashed lines in FIG. 5; and only part of the connector 15 is shown in FIG. 1. It also should be noted that the connector 15 may alternatively be formed separately from and assembled to the primary bobbin 2.

Next, the formation of the overlapping portion 221 of the primary bobbin 2 and the specific separating layer 221*a* will be described with reference to FIGS. 6-9.

Figure 6:
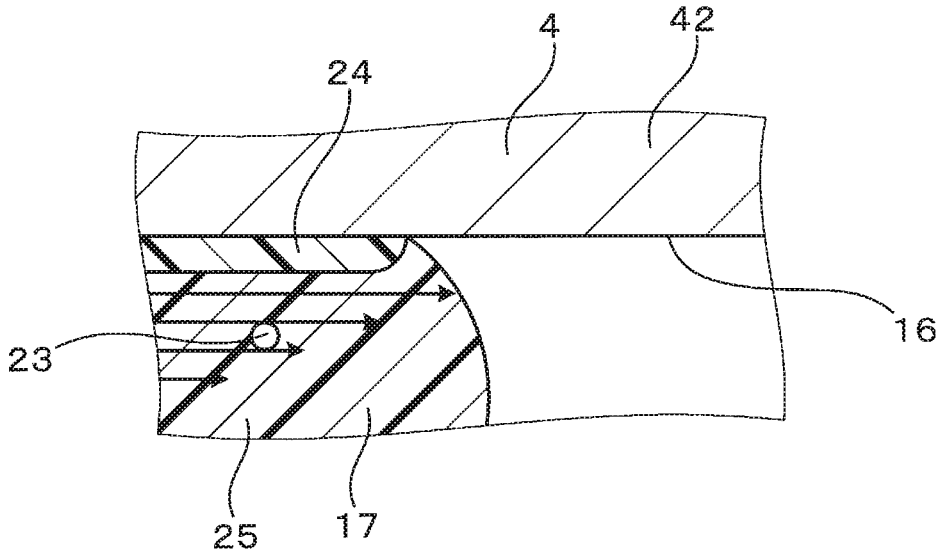
FIG. 6 is a schematic view illustrating the flow of molten resin for forming the primary bobbin of the ignition coil according to the first embodiment.
Figure 7:
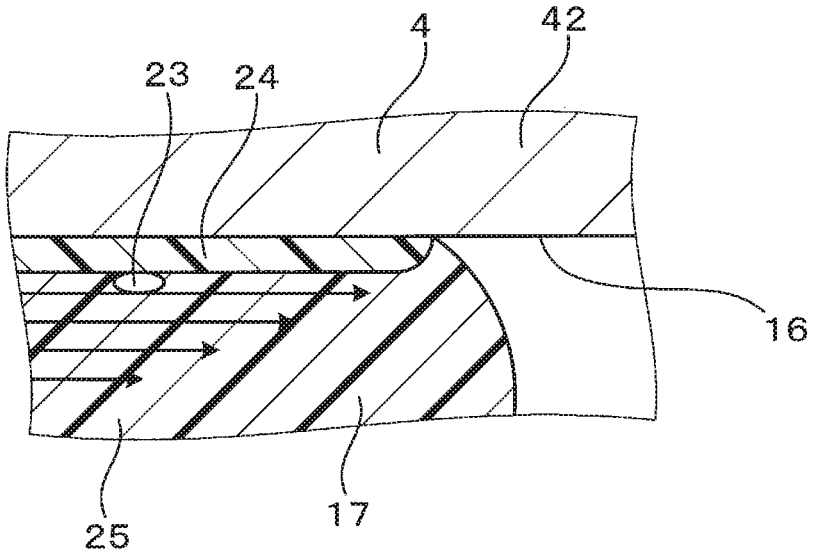
FIG. 7 is a schematic view illustrating the deformation and movement of elastomer particles included in the molten resin for forming the primary bobbin of the ignition coil according to the first embodiment.

As shown in FIG. 6, in forming the primary bobbin 2, a molten resin 17 is supplied to flow into a cavity 16 formed in a metal mold in which the center core 4 is arranged. The molten resin 17 is constituted of the PBT resin and the elastomer particles 23 dispersed in the PBT resin; the elastomer content of the molten resin 17 is 3-10 mass %. In addition, it should be noted that for the sake of simplicity, only one elastomer particle 23 is shown in FIGS. 6 and 7.

As shown in FIG. 6, it is easy for that part of the molten resin 17 which makes contact with the center core 4 to be cooled by the center core 4; therefore, that part of the molten resin 17 is solidified in a relatively early stage, forming a skin layer 24. In contrast, that part of the molten resin 17 which does not make contact with the center core 4 is solidified later, forming a core layer 25; the core layer 25 is located further than the skin layer 24 from the center core 4. Both the skin layer 24 and the core layer 25 are in a state where the elastomer particles 23 are dispersed in the PBT resin.

Moreover, in that part of the molten resin 17 which flows through the vicinity of the solidified skin layer 24, there is created a shear rate gradient in a normal direction to the skin layer 24. More specifically, the shear rate is highest in a region adjoining the skin layer 24 and gradually lowered in the normal direction away from the skin layer 24. Consequently, as shown in FIG. 7, the elastomer particles 23, which are included in the molten resin 17 flowing through the vicinity of the skin layer 24, move to the skin layer 24 side where the shear rate is higher. Moreover, during the movement of the elastomer particles 23 to the skin layer 24 side, the elastomer particles 23 are gradually compressed in the normal direction to the skin layer 24 by the shear stress due to the shear rate gradient in the normal direction. In addition, in FIGS. 6 and 7, the amplitude and direction of the shear stress are indicated with arrows; the higher the shear stress, the longer the arrows.

Furthermore, those elastomer particles 23 which have moved to the surface of the skin layer 24 are further compressed and thereby flattened in the normal direction to the skin layer 24 by the aforementioned shear stress.

Figure 8:
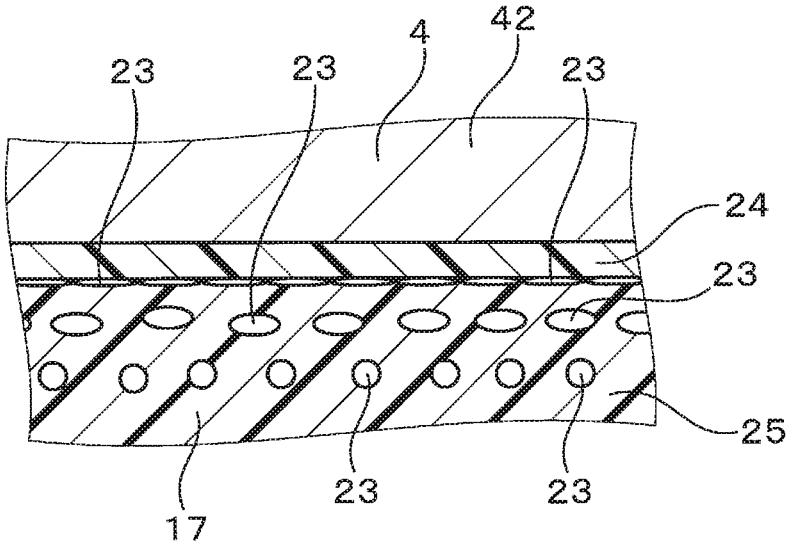
FIG. 8 is a schematic view illustrating the shapes of the elastomer particles which vary depending on the their positions in a normal direction to a skin layer.
Figure 9:
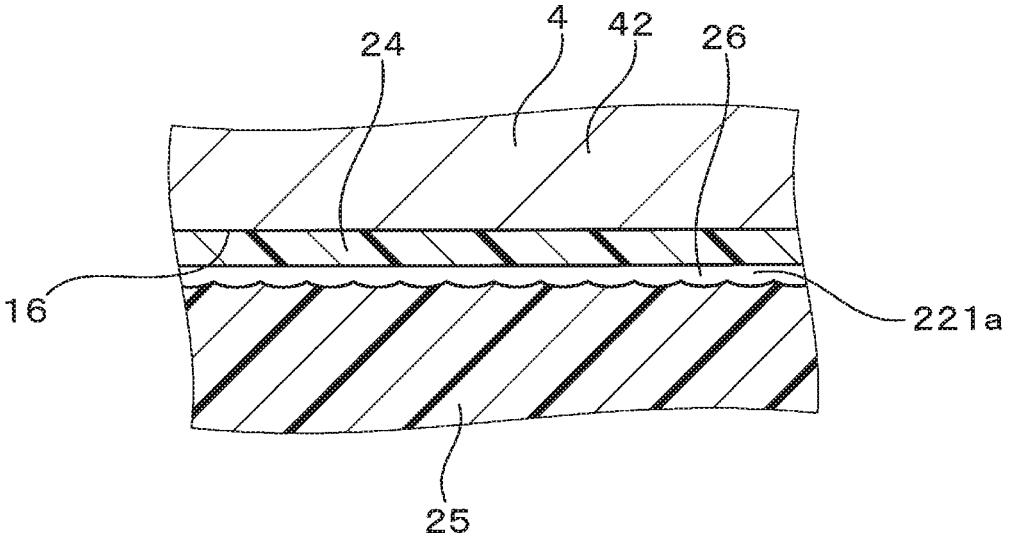
FIG. 9 is a schematic view illustrating an elastomer layer formed of the elastomer particles having aggregated on a surface of the skin layer and flattened.

The above-described movement and deformation are similarly applied to all the elastomer particles 23 included in the molten resin 17 flowing through the vicinity of the skin layer 24. As a result, as shown in FIG. 8, the flattened elastomer particles 23 aggregate on the surface of the skin layer 24, forming an elastomer layer 26 as shown in FIG. 9.

The elasticity of elastomer is lower than that of the PBT resin. Therefore, the strength of the elastomer layer 26 is lower than the strengths of the skin layer 24 and the core layer 25 both of which are formed of the PBT resin and the elastomer particles 23 dispersed in the PBT resin. Consequently, upon the acting of stresses in the coil axial direction X on the periphery thereof, the elastomer layer 26 formed in the overlapping portion 221 of the primary bobbin 2 separates the adjacent layers (i.e., the skin layer 24 and the core layer 25) in the coil axial direction X. In other words, the elastomer layer 26 causes separation between the skin layer 24 and the core layer 25 in the coil axial direction X in the overlapping portion 221 of the primary bobbin 2. That is, the elastomer layer 26 constitutes the specific separating layer 221*a*.

Next, stresses in the coil axial direction X acting on the periphery of the elastomer layer 26 formed in the overlapping portion 221 of the primary bobbin 2 will be described.

During the manufacture of the ignition coil 1, both primary stress and secondary stress are induced in the overlapping portion 221 of the primary bobbin 2 to act on the elastomer layer 26.

Specifically, in manufacturing the ignition coil 1, the components of the ignition coil 1, such as the primary and secondary coils 11 and 12, the primary and secondary bobbins 2 and 3, the center core 4 and the outer core 6, are arranged in the case 7. Then, the mold resin 5 in a liquid state is filled in the case 7. Thereafter, the mold resin 5 is heated and thereby cured.

During the curing, the mold resin 5 undergoes cure shrinkage. Hence, the overlapping portion 221 of the primary bobbin 2 is pulled, by the mold resin 5 undergoing the cure shrinkage, toward the X2 side in the coil axial direction X. On the other hand, the skin layer 24 formed in the overlapping portion 221 of the primary bobbin 2 is bonded and thus fixed to the collar portions 42 of the center core 4. Consequently, the primary stress in the coil axial direction X is induced at the boundary between the skin layer 24 and the elastomer layer 26 formed in the overlapping portion 221 of the primary bobbin 2.

Moreover, when the temperature of the mold resin 5 is lowered after completion of the curing, the mold resin 5 undergoes thermal shrinkage. Hence, the overlapping portion 221 of the primary bobbin 2 is pulled, by the mold resin 5 undergoing the thermal shrinkage, toward the X2 side in the coil axial direction X. On the other hand, the skin layer 24 formed in the overlapping portion 221 of the primary bobbin 2 is bonded and thus fixed to the collar portions 42 of the center core 4; the coefficient of linear expansion of the center core 4 is smaller than the coefficient of linear expansion of the mold resin 5. Consequently, the secondary stress in the coil axial direction X is induced at the boundary between the skin layer 24 and the elastomer layer 26 formed in the overlapping portion 221 of the primary bobbin 2.

As a result, due to the primary and secondary stresses, separation occurs between the skin layer 24 and the elastomer layer 26 or between the elastomer layer 26 and the core layer 25 formed in the overlapping portion 221 of the primary bobbin 2. In this way, the specific separating layer 221*a*, which is constituted of the elastomer layer 26, separates the adjacent layers.

Moreover, in the overlapping portion 221 of the primary bobbin 2, the one or more other separating layers 20 than the specific separating layer 221*a* are also formed on the same principle as the specific separating layer 221*a*.

Furthermore, on the same principle, a skin layer 24 may be formed on the metal mold side and a separating layer 20 may be formed on the surface of the skin layer 24.

In addition, in the present specification, the term "specific separating layer" is used only for the purpose of distinguishing the separating layer 221*a* that separates the adjacent layers in the coil axial direction X from the one or more other separating layers 20; thus the modifier "specific" has no special meaning.

According to the present embodiment, it is possible to achieve the following advantageous effects.

In the ignition coil 1 according to the present embodiment, in the overlapping portion 221 of the primary bobbin 2, there is formed the specific separating layer 221*a* that separates the adjacent layers (i.e., the skin layer 24 and the core layer 25) in the coil axial direction X. Hence, that part of the overlapping portion 221 of the primary bobbin 2 which is on the secondary bobbin 3 side of the specific separating layer 221*a* is separated from the specific separating layer 221*a*; thus it is difficult for that part of the overlapping portion 221 to be restrained by the collar portions 42 of the center core 4 when the temperature of the ignition coil 1 is changed from high to low. Consequently, when the temperature of the ignition coil 1 is changed from high to low, it is possible to prevent stress concentration from occurring at the boundary between the collar portion 22 of the primary bobbin 2 and the secondary bobbin 3 in the coil axial direction X. As a result, it is possible to suppress cracks from occurring in the ignition coil 1, thereby ensuring high electrical reliability of the ignition coil 1.

In the ignition coil 1 according to the present embodiment, when viewed along the height direction Z that is perpendicular to both the coil axial direction X and the protruding direction Y, the length L1 of the specific separating layer 221*a* is greater than or equal to the first predetermined length Lb; the first predetermined length Lb is ⅓ of the length La of each of the collar portions 42 of the center core 4 in the protruding direction Y. It has been confirmed that with the length L1 of the specific separating layer 221*a* set as above, it is possible to further reduce stress at the boundary between the collar portion 22 of the primary bobbin 2 and the secondary bobbin 3 in the coil axial direction X.

In the ignition coil 1 according to the present embodiment, the length L2 of the specific separating layer 221*a* in the height direction Z is greater than or equal to the second predetermined length Ld; the second predetermined length Ld is ½ of the length Lc of each of the collar portions 42 of the center core 4 in the height direction Z. It has been confirmed that with the length L2 of the specific separating layer 221*a* set as above, it is possible to further reduce stress at the boundary between the collar portion 22 of the primary bobbin 2 and the secondary bobbin 3 in the coil axial direction X.

In the ignition coil 1 according to the present embodiment, at least part of the specific separating layer 221*a* is formed to overlap both the front surface 31 of the secondary bobbin 3 and the collar portions 42 of the center core 4 in the coil axial direction X; the front surface 31 of the secondary bobbin 3 faces the primary bobbin 2 in the coil axial direction X. Consequently, it becomes more difficult for that part of the overlapping portion 221 of the primary bobbin 2 which is on the secondary bobbin 3 side of the specific separating layer 221*a* to be restrained by the collar portions 42 of the center core 4 when the temperature of the ignition coil 1 is changed from high to low. As a result, it becomes possible to more reliably prevent stress concentration from occurring at the boundary between the collar portion 22 of the primary bobbin 2 and the secondary bobbin 3 in the coil axial direction X when the temperature of the ignition coil 1 is changed from high to low.

In the ignition coil 1 according to the present embodiment, the dispersed-phase particles are elastomer particles 23. Therefore, during the formation of the primary bobbin 2, the dispersed-phase particles can be easily deformed. Consequently, the dispersed-phase particles can be easily flattened and aggregate to form the specific separating layer 221*a*.

To sum up, according to the present embodiment, it becomes possible to provide the ignition coil 1 which has high electrical reliability.

Second Embodiment

An ignition coil 1 according to the second embodiment has almost the same configuration as the ignition coil 1 according to the first embodiment. Accordingly, only the differences therebetween will be described hereinafter.

As described previously, in the ignition coil 1 according to the first embodiment, in the overlapping portion 221 of the primary bobbin 2, there is formed the specific separating layer 221*a* that separates the adjacent layers in the coil axial direction X (see FIGS. 2 and 4).

Figure 15:
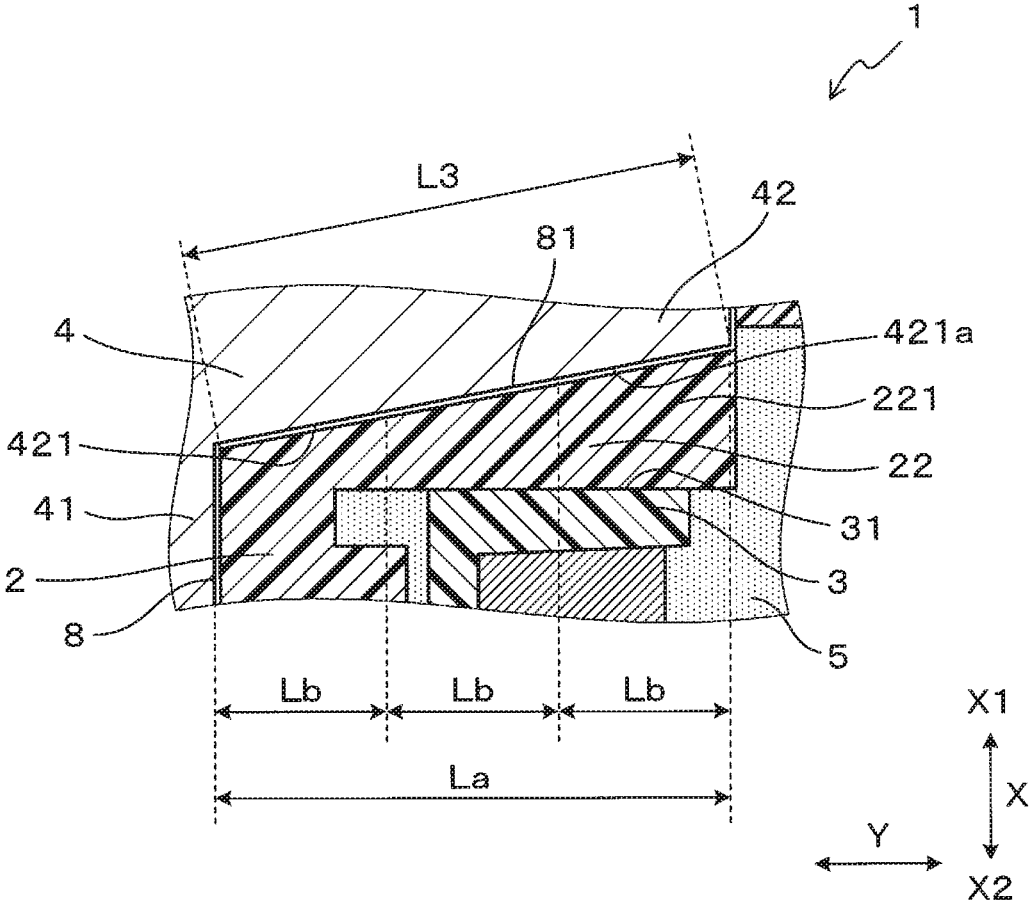
FIG. 15 is an enlarged cross-sectional view, taken perpendicular to a height direction, of part of an ignition coil according to a second embodiment around an overlapping portion of a primary bobbin of the ignition coil.
Figure 16:
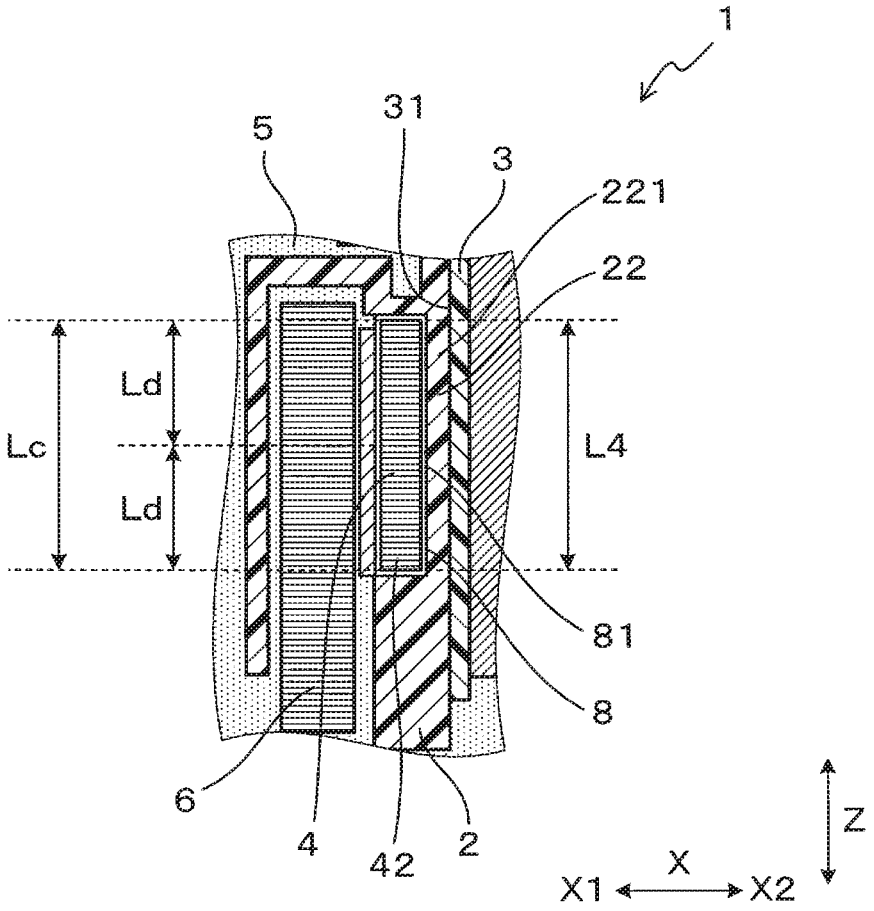
FIG. 16 is an enlarged cross-sectional view, taken perpendicular to a protruding direction, of part of the ignition coil according to the second embodiment around the overlapping portion of the primary bobbin.

In contrast, in the ignition coil 1 according to the present embodiment, as shown in FIGS. 15 and 16, there is no specific separating layer 221*a* formed in the overlapping portion 221 of the primary bobbin 2. Instead, a separating member 8 is provided, at least between the overlapping portion 221 of the primary bobbin 2 and the collar portions 42 of the center core 4, to cause separation between the primary bobbin 2 and the center core 4. In addition, it should be noted that for the sake of simplicity, the separating member 8 is not hatched in the figures.

The separating member 8 is formed of a material having releasability to either of the center core 4 and the primary bobbin 2. Moreover, it is preferable that the separating member 8 has releasability to the mold resin 5.

More particularly, in the present embodiment, the separating member 8 is formed of silicone. Moreover, the separating member 8 is formed over the entire surface of the center core 4. Specifically, the separating member 8 is formed by: 1) immersing the entire center core 4 in a silicone solution contained in a solution vessel; 2) removing the center core 4 from the solution vessel; and 3) drying the silicone solution remaining on the surface of the center core 4.

In addition, it should be noted that the separating member 8 may alternatively be formed of materials other than silicone, such as an oil, a PET (polyethylene terephthalate) tape or a fluorocarbon resin.

As shown in FIGS. 15 and 16, part of the separating member 8 is provided to overlap both the front surface 31 of the secondary bobbin 3 and the collar portions 42 of the center core 4 in the coil axial direction X; the front surface 31 of the secondary bobbin 3 faces the primary bobbin 2 in the coil axial direction X. Moreover, the separating member 8 is provided, at least, on end portions 421*a* of the back surfaces 421 of the collar portions 42 of the center core 4 on the sides to which the collar portions 42 of the center core 4 respectively protrude from the main body 41 of the center core 4 (i.e., end portions 421*a* of the back surfaces 421 of the collar portions 42 of the center core 4 respectively on the opposite sides to the main body 41 of the center core 4 in the protruding direction Y).

As shown in FIG. 15, when viewed along the height direction Z, a specific separating portion 81 of the separating member 8, which is interposed between the overlapping portion 221 of the primary bobbin 2 and the collar portions 42 of the center core 4, has a length L3 that is greater than or equal to the first predetermined length Lb; the first predetermined length Lb is ⅓ of the length La of each of the collar portions 42 of the center core 4 in the protruding direction Y. In other words, when viewed along the height direction Z, the length L3 of the specific separating portion 81 in the longitudinal direction of the separating member 8 is greater than or equal to ⅓ of the length La of each of the collar portions 42 of the center core 4 in the protruding direction Y.

In addition, in the present specification, the term "specific separating portion" is used only for the purpose of distinguishing that portion 81 of the separating member 8 which is interposed between the overlapping portion 221 of the primary bobbin 2 and the collar portions 42 of the center core 4 from the other portions of the separating member 8; thus the modifier "specific" has no special meaning.

In the present embodiment, the specific separating portion 81 of the separating member 8 is formed continuously from the inner end to the outer end of the overlapping portion 221 of the primary bobbin 2 in the protruding portion Y.

Figure 17:
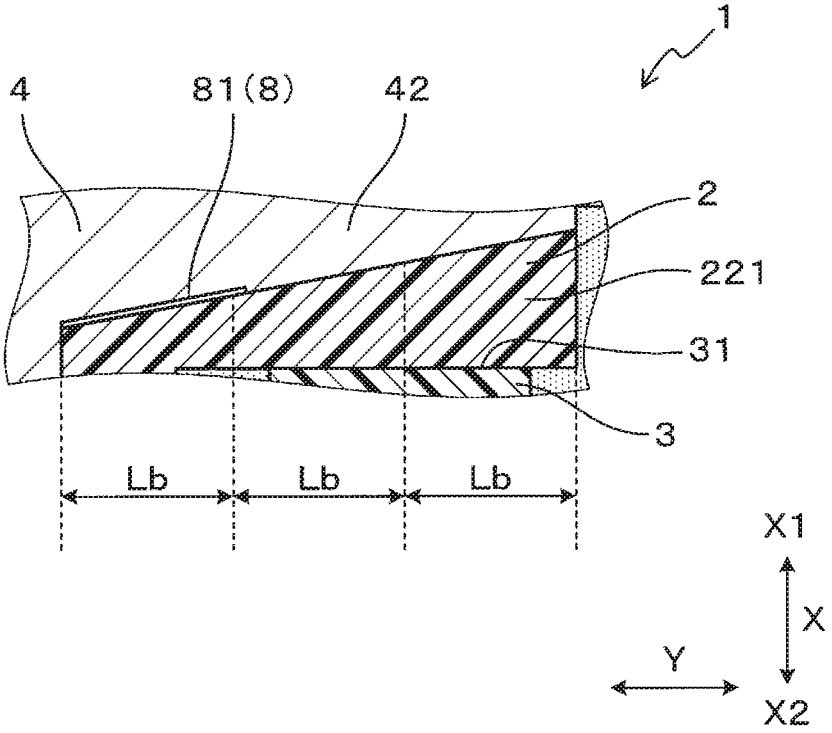
FIG. 17 is an enlarged cross-sectional view, corresponding to FIG. 15, illustrating a first modification of the second embodiment.
Figure 18:
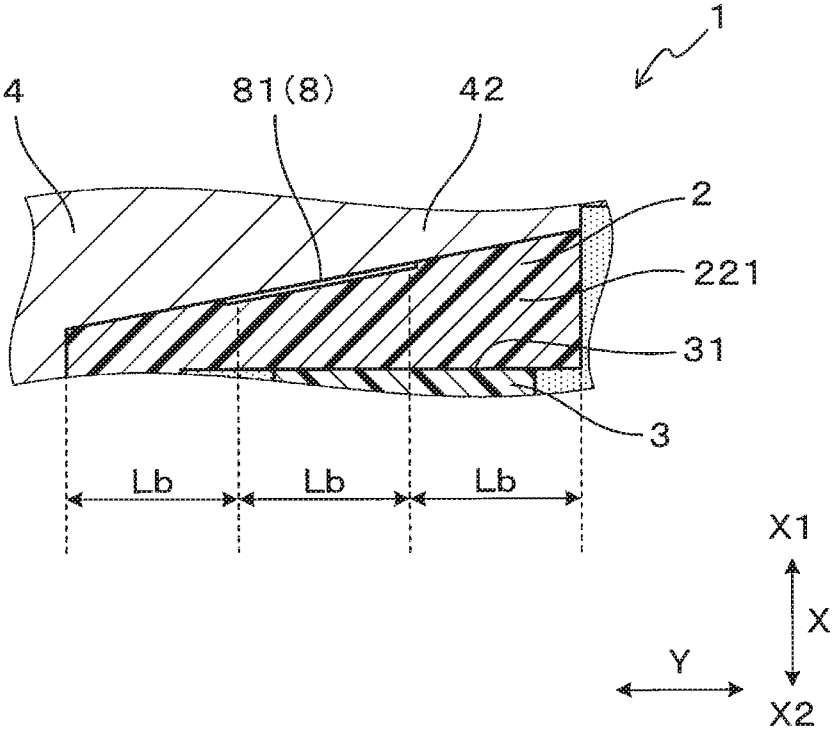
FIG. 18 is an enlarged cross-sectional view, corresponding to FIG. 15, illustrating a second modification of the second embodiment.
Figure 19:
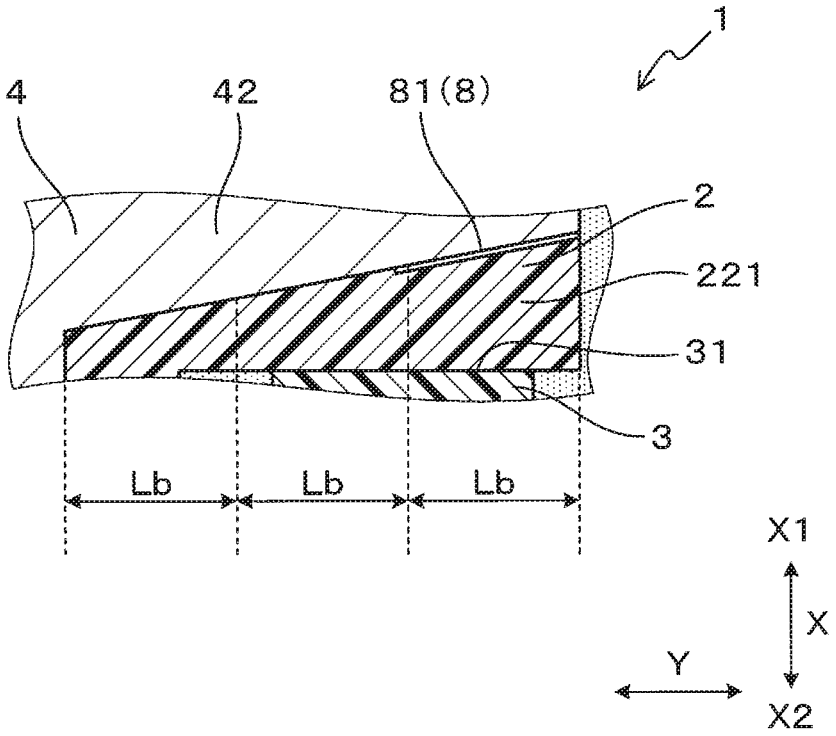
FIG. 19 is an enlarged cross-sectional view, corresponding to FIG. 15, illustrating a third modification of the second embodiment.

The formation range and formation location of the specific separating portion 81 as viewed along the height direction Z are not particularly limited provided that the length L3 of the specific separating portion 81 is greater than or equal to the first predetermined length Lb. For example, the specific separating portion 81 may alternatively be formed as shown in FIGS. 17-19.

Figure 20:
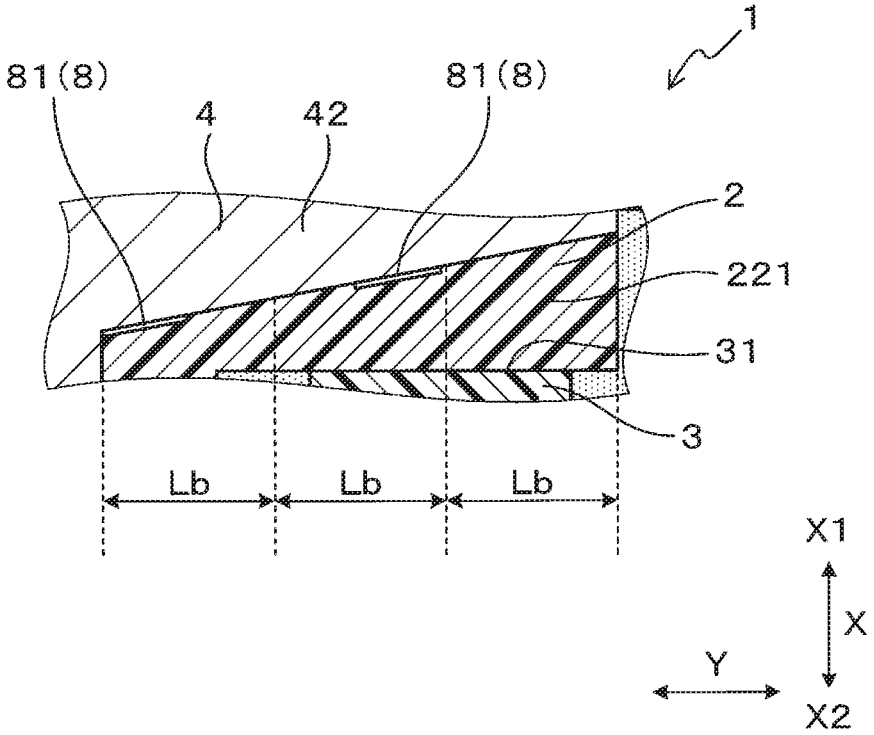
FIG. 20 is an enlarged cross-sectional view, corresponding to FIG. 15, illustrating a fourth modification of the second embodiment.
Figure 21:
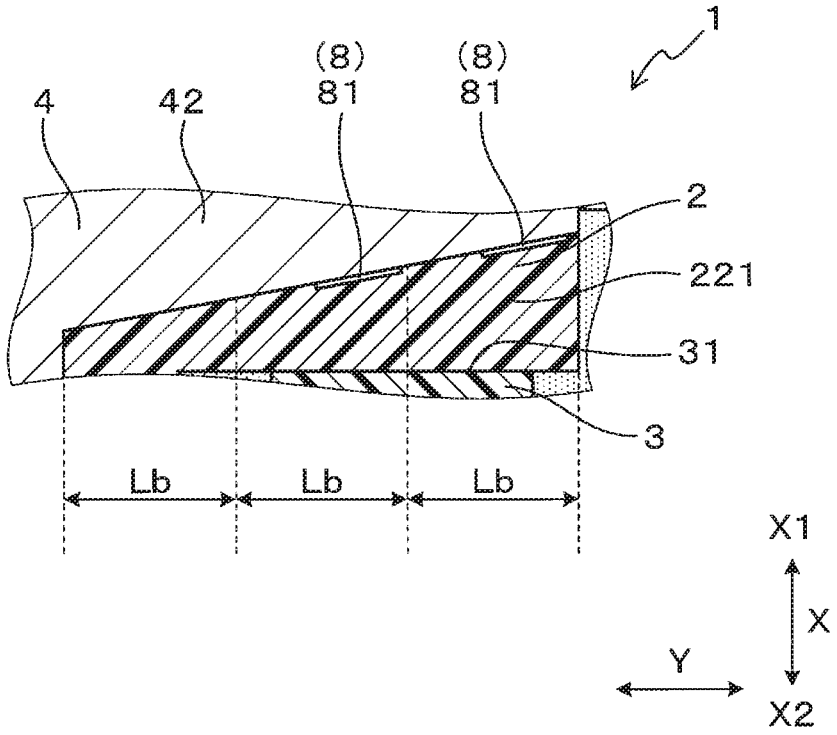
FIG. 21 is an enlarged cross-sectional view, corresponding to FIG. 15, illustrating a fifth modification of the second embodiment.
Figure 22:
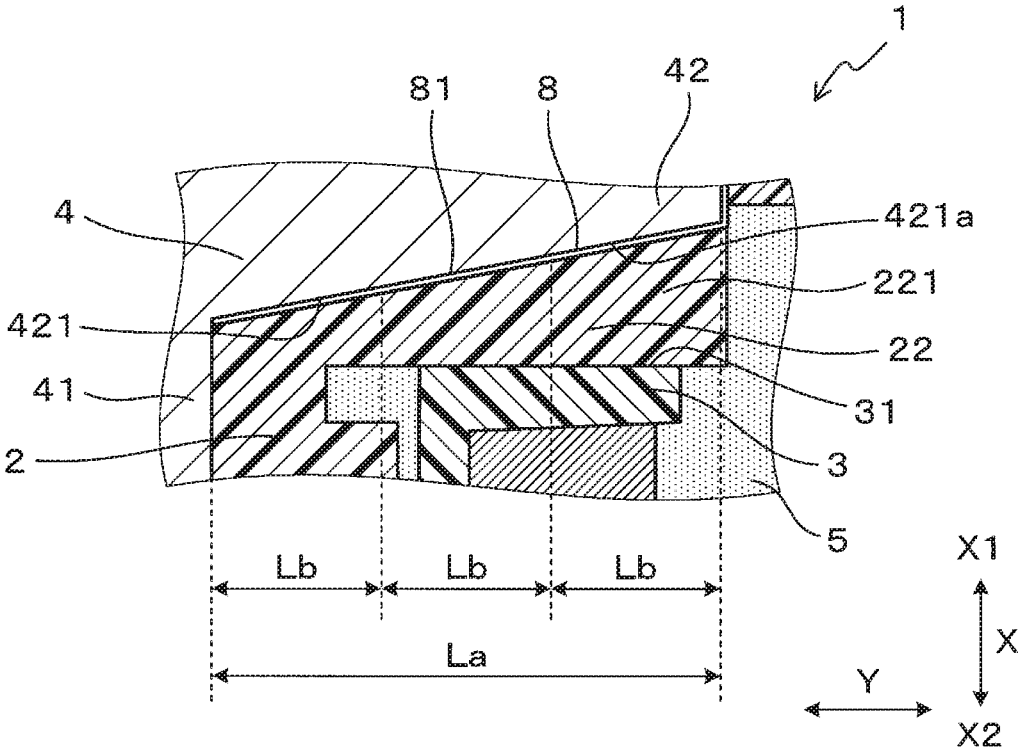
FIG. 22 is an enlarged cross-sectional view, taken perpendicular to a height direction, of part of an ignition coil according to a third embodiment around an overlapping portion of a primary bobbin of the ignition coil.

Moreover, the specific separating portion 81 may alternatively be formed discontinuously to include a plurality of segments as shown in FIGS. 20 and 21. In this case, it is preferable that when viewed along the height direction Z, the sum of lengths of the segments of the specific separating portion 81 be greater than or equal to the first predetermined length Lb.

As shown in FIG. 16, the specific separating portion 81 of the separating member 8 has a length L4 in the height direction Z; the length L4 is greater than or equal to the second predetermined length Ld that is ½ of the length Lc of each of the collar portions 42 of the center core 4 in the height direction Z.

More particularly, in the present embodiment, the specific separating portion 81 of the separating member 8 is formed continuously in the height direction Z to have its length L4 equal to the length Lc of each of the collar portions 42 of the center core 4 in the height direction Z.

The formation range and formation location of the specific separating portion 81 in the height direction Z are not particularly limited provided that the length L4 of the specific separating portion 81 is greater than or equal to the second predetermined length Ld. Moreover, the specific separating portion 81 may alternatively be formed discontinuously in the height direction Z to include a plurality of segments. In this case, it is preferable that the sum of lengths of the segments of the specific separating portion 81 in the height direction Z be greater than or equal to the second predetermined length Ld.

In the present embodiment, the primary bobbin 2 is formed, for example, of a PBT resin without dispersed-phase particles dispersed in the PBT resin. Consequently, there is no specific separating layer 221*a* formed in the overlapping portion 221 of the primary bobbin 2.

In addition, it should be noted that in the present embodiment, the primary bobbin 2 may alternatively be formed of a PBT resin and dispersed-phase particles dispersed in the PBT resin, thereby having a specific separating layer 221*a* formed in the overlapping portion 221 of the primary bobbin 2 as in the first embodiment.

According to the present embodiment, it is possible to achieve the following advantageous effects.

In the ignition coil 1 according to the present embodiment, the separating member 8 is provided, at least between the overlapping portion 221 of the primary bobbin 2 and the collar portions 42 of the center core 4, to cause separation between the primary bobbin 2 and the center core 4. Hence, when the temperature of the ignition coil 1 is changed from high to low, the overlapping portion 221 of the primary bobbin 2 is separated from the collar portions 42 of the center core 4; thus the overlapping portion 221 of the primary bobbin 2 is not restrained by the collar portions 42 of the center core 4. Consequently, when the temperature of the ignition coil 1 is changed from high to low, it is possible to prevent stress concentration from occurring at the boundary between the collar portion 22 of the primary bobbin 2 and the secondary bobbin 3 in the coil axial direction X. As a result, it is possible to suppress cracks from occurring in the ignition coil 1, thereby ensuring high electrical reliability of the ignition coil 1.

In the ignition coil 1 according to the present embodiment, when viewed along the height direction Z that is perpendicular to both the coil axial direction X and the protruding direction Y, the length L3 of the specific separating portion 81 of the separating member 8 is greater than or equal to the first predetermined length Lb; the first predetermined length Lb is ⅓ of the length La of each of the collar portions 42 of the center core 4 in the protruding direction Y. It has been confirmed that with the length L3 of the specific separating portion 81 set as above, it is easy for the separating member 8 to cause separation between the overlapping portion 221 of the primary bobbin 2 and the collar portions 42 of the center core 4 in the coil axial direction X. Consequently, it is possible to further reduce stress at the boundary between the collar portion 22 of the primary bobbin 2 and the secondary bobbin 3 in the coil axial direction X.

In the ignition coil 1 according to the present embodiment, the length L4 of the specific separating portion 81 of the separating member 8 in the height direction Z is greater than or equal to the second predetermined length Ld; the second predetermined length Ld is ½ of the length Lc of each of the collar portions 42 of the center core 4 in the height direction Z. It has been confirmed that with the length L4 of the specific separating portion 81 set as above, it is easy for the separating member 8 to cause separation between the overlapping portion 221 of the primary bobbin 2 and the collar portions 42 of the center core 4 in the coil axial direction X. Consequently, it is possible to further reduce stress at the boundary between the collar portion 22 of the primary bobbin 2 and the secondary bobbin 3 in the coil axial direction X.

In the ignition coil 1 according to the present embodiment, at least part of the separating member 8 is provided to overlap both the front surface 31 of the secondary bobbin 3 and the collar portions 42 of the center core 4 in the coil axial direction X; the front surface 31 of the secondary bobbin 3 faces the primary bobbin 2 in the coil axial direction X. Consequently, when the temperature of the ignition coil 1 is changed from high to low, it is easy for that part of the overlapping portion 221 of the primary bobbin 2 which overlaps the front surface 31 of the secondary bobbin 3 in the coil axial direction X to be separated from the collar portions 42 of the center core 4. As a result, it becomes possible to more reliably prevent stress concentration from occurring at the boundary between the collar portion 22 of the primary bobbin 2 and the secondary bobbin 3 in the coil axial direction X when the temperature of the ignition coil 1 is changed from high to low.

In the ignition coil 1 according to the present embodiment, the separating member 8 is provided, at least, on the end portions 421*a* of the back surfaces 421 of the collar portions 42 of the center core 4 on the sides to which the collar portions 42 of the center core 4 respectively protrude from the main body 41 of the center core 4. Consequently, when the temperature of the ignition coil 1 is changed from high to low, it is easy for the separating member 8 to cause separation between the overlapping portion 221 of the primary bobbin 2 and the collar portions 42 of the center core 4 in the coil axial direction X.

More specifically, on the radially inner side (i.e., the main body 21 side) of the collar portion 22 of the primary bobbin 2, there is formed the main body 21 of the primary bobbin 2 and thus the primary bobbin 2 is shaped to be long in the coil axial direction X. Hence, when the temperature of the ignition coil 1 is changed from high to low, the radially inner part of the primary bobbin 2 thermally shrinks greatly. Accordingly, it is easy for the force acting on the radially inner part of the overlapping portion 221 of the primary bobbin 2 in the coil axial direction X away from the collar portions 42 of the center core 4 to become large; thus it is easy for the radially inner part of the overlapping portion 221 of the primary bobbin 2 to be separated from the collar portions 42 of the center core 4 in the coil axial direction X.

On the other hand, it is easy for the radially outer part of the overlapping portion 221 of the primary bobbin 2 to keep intimate contact with the collar portions 42 of the center core 4 when the temperature of the ignition coil 1 is changed from high to low.

In view of the above, as described previously, the separating member 8 is provided, at least, on the end portions 421*a* of the back surfaces 421 of the collar portions 42 of the center core 4 on the sides to which the collar portions 42 of the center core 4 respectively protrude from the main body 41 of the center core 4. Consequently, it becomes possible to promote separation of the radially outer part of the overlapping portion 221 of the primary bobbin 2 from the collar portions 42 of the center core 4. As a result, it becomes easy to promote separation of the entire overlapping portion 221 of the primary bobbin 2 from the collar portions 42 of the center core 4, thereby making it easy to further reduce stress at the boundary between the collar portion 22 of the primary bobbin 2 and the secondary bobbin 3 in the coil axial direction X.

To sum up, according to the present embodiment, it becomes possible to provide the ignition coil 1 which has high electrical reliability.

Third Embodiment

An ignition coil 1 according to the third embodiment has almost the same configuration as the ignition coil 1 according to the second embodiment. Accordingly, only the differences therebetween will be described hereinafter.

As described previously, in the ignition coil 1 according to the second embodiment, the separating member 8 is formed over the entire surface of the center core 4.

In contrast, in the ignition coil 1 according to the present embodiment, as shown in FIGS. 22-25, the separating member 8 is formed on only part of the surface of the center core 4. Specifically, the separating member 8 is formed only in a region which is on the collar portions 42 side (i.e., the X1 side) of the center of the center core 4 in the coil axial direction X. That is, no separating member 8 is formed on the X2 side of the center of the center core 4 in the coil axial direction X.

More particularly, in the present embodiment, the separating member 8 is formed, on the surface of the center core 4, over the entire region from the X1-side end of the center core 4 to the X2-side ends of the collar portions 42 of the center core 4 in the coil axial direction X.

Next, a method of forming the separating member 8 on the surface of the center core 4 according to the present embodiment will be described with reference to FIGS. 23-25.

Figure 23:
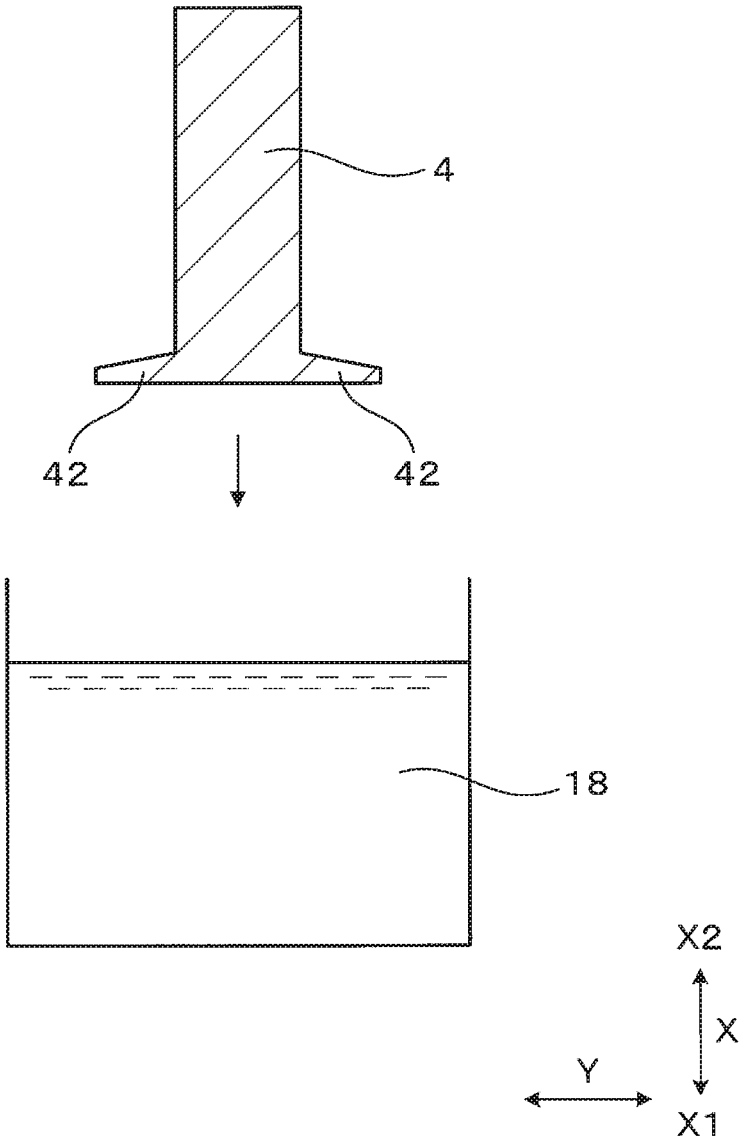
FIG. 23 is a schematic view illustrating a method of forming a separating member on a surface of a center core of the ignition coil according to the third embodiment, wherein the center core has not been immersed in a silicone solution contained in a solution vessel.
Figure 24:
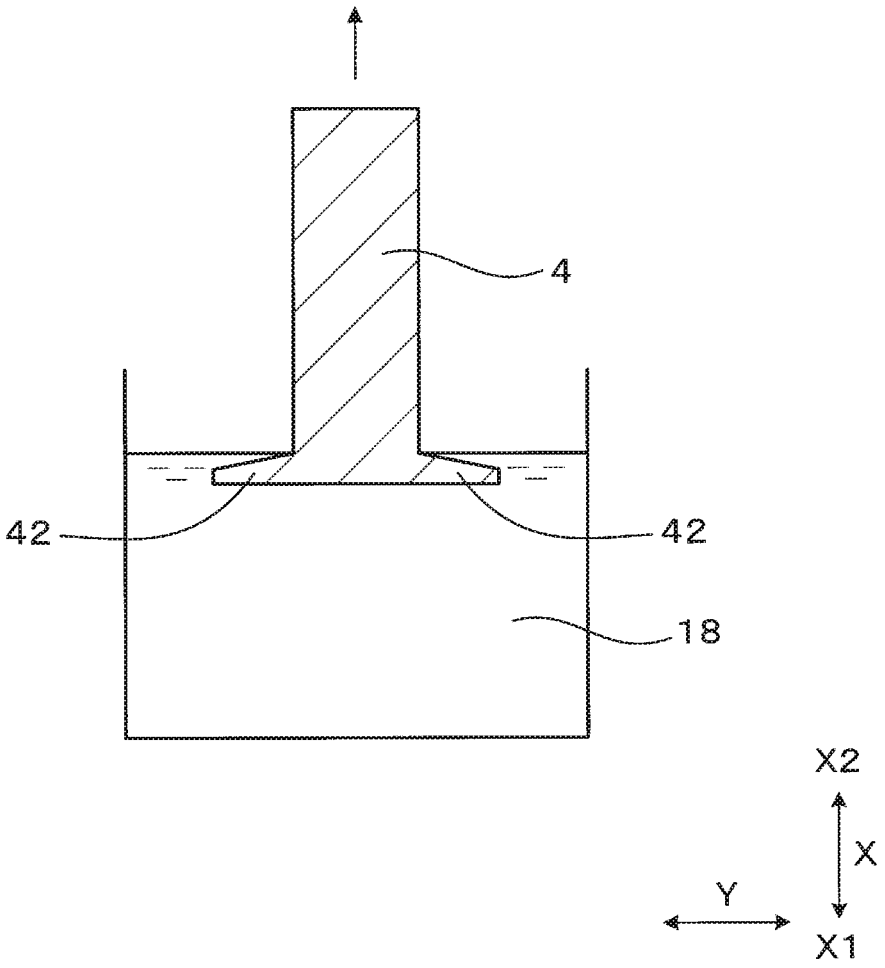
FIG. 24 is another schematic view illustrating the method of forming the separating member on the surface of the center core of the ignition coil according to the third embodiment, wherein the center core has been partially immersed in the silicone solution contained in the solution vessel.

First, referring to FIGS. 23 and 24, the center core 4 is partially immersed in a silicone solution 18, which is contained in a solution vessel, from the X1-side end of the center core 4 in the coil axial direction X. More particularly, in the present embodiment, the center core 4 is immersed in the silicone solution 18 from the X1-side end of the center core 4 to the X2-side ends of the collar portions 42 of the center core 4 in the coil axial direction X, with the remaining part of the center core 4 exposed from the silicone solution 18.

Figure 25:
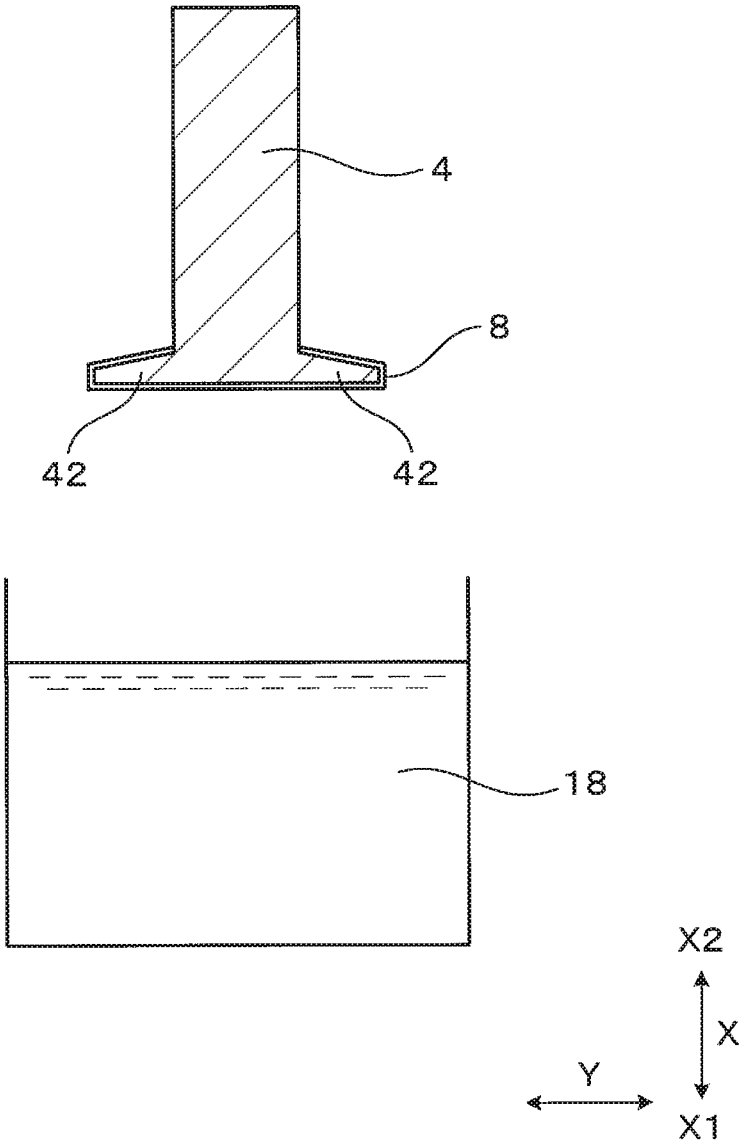
FIG. 25 is yet another schematic view illustrating the method of forming the separating member on the surface of the center core of the ignition coil according to the third embodiment, wherein the center core has been removed from the solution vessel and the separating member has been formed on the surface of the center core.

Then, referring to FIGS. 24 and 25, the center core 4 is removed from the solution vessel and the silicone solution 18 remaining on the surface of the center core 4 is dried. As a result, the separating member 8 is formed, on the surface of the center core 4, over the entire region from the X1-side end of the center core 4 to the X2-side ends of the collar portions 42 of the center core 4 in the coil axial direction X.

According to the present embodiment, it is possible to achieve the same advantageous effects as described in the second embodiment.

Moreover, in the ignition coil 1 according to the present embodiment, the separating member 8 is formed only in a region which is on the collar portions 42 side of the center of the center core 4 in the coil axial direction X. Hence, compared to the case of forming the separating member 8 over the entire surface of the center core 4 as in the second embodiment, it is possible to reduce the time required to form the separating member 8. More specifically, it is possible to reduce both the time required to immerse the center core 4 in the silicone solution 18 contained in the solution vessel and the time required to dry the silicone solution 18 remaining on the surface of the center core 4 after removing the center core 4 from the solution vessel. Consequently, it is possible to improve the productivity of the entire ignition coil 1. Moreover, compared to the case of forming the separating member 8 over the entire surface of the center core 4, the quantity of the silicone solution 18 necessary for forming the separating member 8 is reduced. Consequently, it is also possible to reduce the manufacturing cost of the entire ignition coil 1.

Fourth Embodiment

An ignition coil 1 according to the fourth embodiment has almost the same configuration as the ignition coil 1 according to the second embodiment. Accordingly, only the differences therebetween will be described hereinafter.

As described previously, in the ignition coil 1 according to the second embodiment, the separating member 8 is formed over the entire surface of the center core 4.

Figure 26:
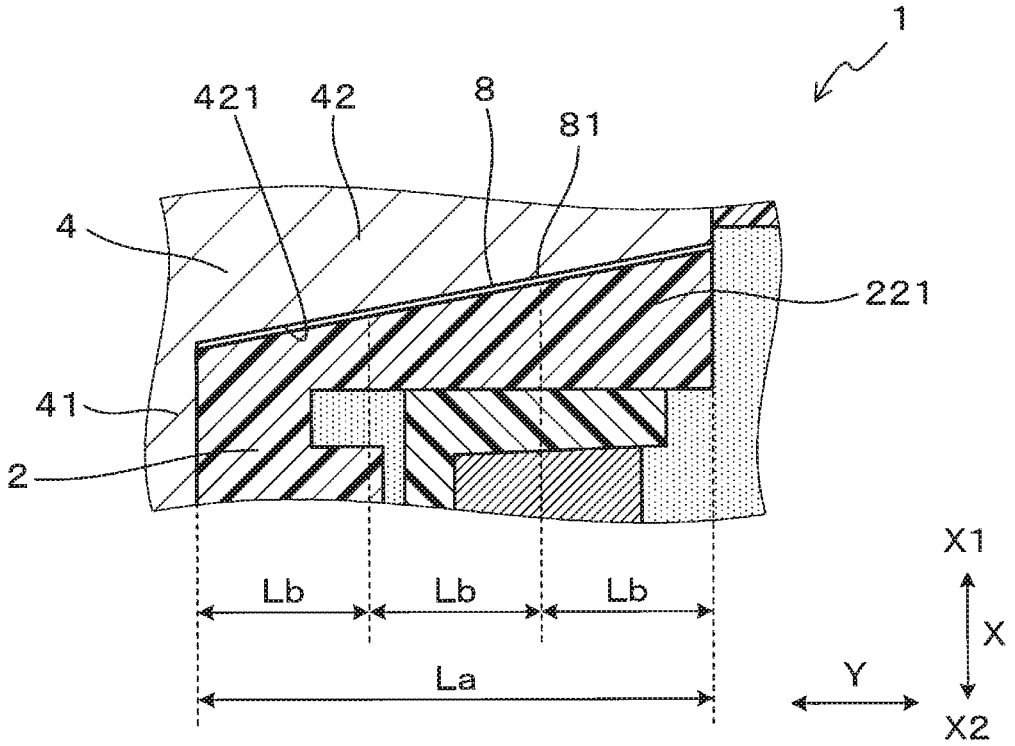
FIG. 26 is an enlarged cross-sectional view, taken perpendicular to a height direction, of part of an ignition coil according to a fourth embodiment around an overlapping portion of a primary bobbin of the ignition coil.
Figure 27:
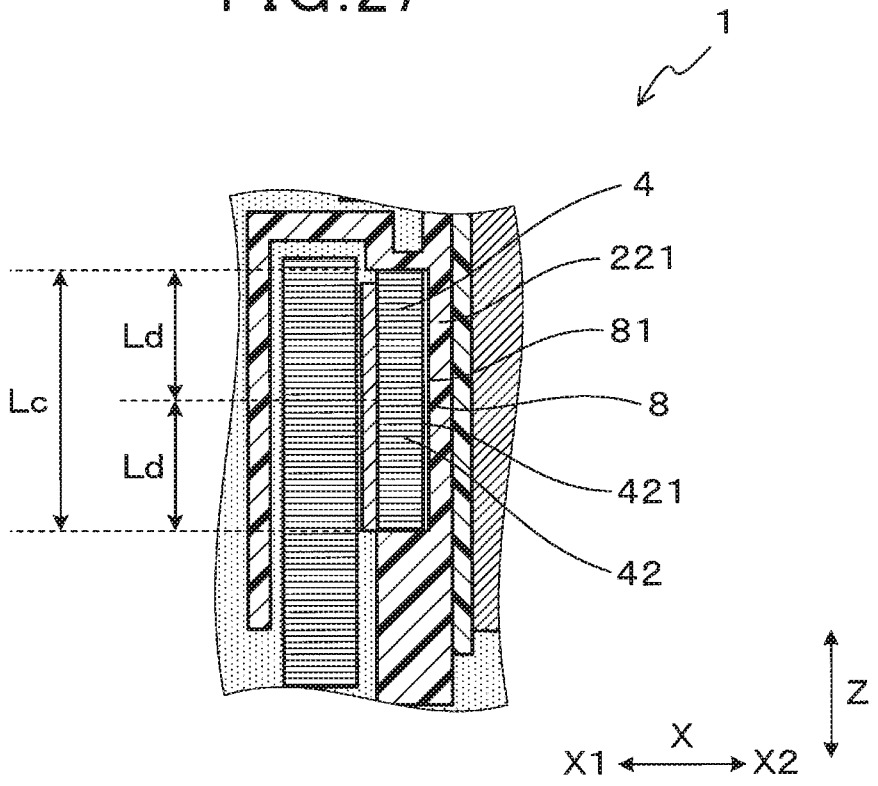
FIG. 27 is an enlarged cross-sectional view, taken perpendicular to a protruding direction, of part of the ignition coil according to the fourth embodiment around the overlapping portion of the primary bobbin.

In contrast, in the ignition coil 1 according to the present embodiment, as shown in FIGS. 26 and 27, the separating member 8 is formed on only part of the surface of the center core 4 so as to be interposed only between the overlapping portion 221 of the primary bobbin 2 and the collar portions 42 of the center core 4.

More particularly, in the present embodiment, the separating member 8 is formed on the substantially entire back surfaces 421 of the collar portions 42 of the center core 4.

In addition, it should be noted that the separating member 8 may alternatively be formed on only part of each of the back surfaces 421 of the collar portions 42 of the center core 4. That is, the separating member 8 is not necessary provided in the entire minute gap between the overlapping portion 221 of the primary bobbin 2 and the collar portions 42 of the center core 4. In other words, the separating member 8 may be provided in only part of the minute gap between the overlapping portion 221 of the primary bobbin 2 and the collar portions 42 of the center core 4. For example, the separating member 8 may be provided in only an outer part of the minute gap between the overlapping portion 221 of the primary bobbin 2 and the collar portions 42 of the center core 4 which is on the outer side of the center of the minute gap (i.e., on the opposite side of the minute gap to the main body 41 of the center core 4) in the protruding direction Y.

Moreover, in the present embodiment, the separating member 8 is formed by bonding a PET tape to the back surfaces 421 of the collar portions 42 of the center core 4. Therefore, compared to the second and third embodiments, it is possible to more easily form the separating member 8.

In addition, in the present embodiment, the separating member 8 may alternatively be formed on only a desired part of the surface of the center core 4 by: 1) masking the other part of the surface of the center core 4 than the desired part with a masking tape; 2) immersing the center core 4 in a silicone solution contained in a solution vessel; 3) removing the center core 4 from the solution vessel; 4) drying the silicone solution remaining on the desired part of the surface of the center core 4; and 5) stripping the masking tape from the other part of the surface of the center core 4.

According to the present embodiment, it is possible to achieve the same advantageous effects as described in the second embodiment.

Moreover, in the ignition coil 1 according to the present embodiment, the separating member 8 is provided only between the overlapping portion 221 of the primary bobbin 2 and the collar portions 42 of the center core 4. Therefore, it is possible to easily form the separating member 8 by bonding a PET tape to the back surfaces 421 of the collar portions 42 of the center core 4.

While the above particular embodiments and modifications have been shown and described, it will be understood by those skilled in the art that various further modifications, changes, and improvements may be made without departing from the spirit of the present invention.

What is claimed is:

1. An ignition coil for an internal combustion engine, the ignition coil comprising:

a primary coil and a secondary coil that are magnetically coupled with each other;

a primary bobbin having the primary coil wound thereon;

a secondary bobbin having the secondary coil wound thereon;

a center core; and a mold resin having the primary coil, the secondary coil, the primary bobbin, the secondary bobbin and the center core embedded therein, wherein the center core has a main body arranged inside the primary bobbin and a pair of collar portions protruding from the main body respectively to opposite sides in a protruding direction crossing a coil axial direction, the primary bobbin has, in one part thereof in the coil axial direction, a main body on which the primary coil is wound, the primary bobbin also has, in another part thereof in the coil axial direction, a collar portion that is at least partially sandwiched between the collar portions of the center core and the secondary bobbin in the coil axial direction, the collar portion of the primary bobbin includes an overlapping portion of the primary bobbin which overlaps the collar portions of the center core in the coil axial direction, the overlapping portion of the primary bobbin is bonded to the collar portions of the center core, the primary bobbin is formed of a thermoplastic resin and dispersed-phase particles that are dispersed in the thermoplastic resin and have a lower elasticity than the thermoplastic resin, and in the overlapping portion of the primary bobbin, there is formed a specific separating layer that separates adjacent layers in the coil axial direction, the adjacent layers being formed in the overlapping portion of the primary bobbin and located respectively on opposite sides of the specific separating layer in the coil axial direction.

2. The ignition coil as set forth in claim 1, wherein when viewed along a height direction that is perpendicular to both the coil axial direction and the protruding direction, the specific separating layer has a length greater than or equal to a first predetermined length, the first predetermined length being ⅓ of a length of each of the collar portions of the center core in the protruding direction.

3. The ignition coil as set forth in claim 1, wherein a length of the specific separating layer in a height direction is greater than or equal to a second predetermined length, the height direction being perpendicular to both the coil axial direction and the protruding direction, the second predetermined length being ½ of a length of each of the collar portions of the center core in the height direction.

4. The ignition coil as set forth in claim 1, wherein at least part of the specific separating layer is formed to overlap both a front surface of the secondary bobbin and the collar portions of the center core in the coil axial direction, the front surface of the secondary bobbin facing the primary bobbin in the coil axial direction.

5. The ignition coil as set forth in claim 1, wherein the dispersed-phase particles are elastomer particles.

6. The ignition coil as set forth in claim 1, wherein the separating layer is formed along a plane parallel to a front surface of the overlapping portion.

7. The ignition coil as set forth in claim 1, wherein the separating layer is formed along a plane oblique and non-perpendicular to the coil axial direction.

* * * * *